US011833707B2

(12) United States Patent
Duxbury

(10) Patent No.: US 11,833,707 B2
(45) Date of Patent: Dec. 5, 2023

(54) FENCE AND STOP ASSEMBLY SYSTEM AND METHOD OF USE THEREOF

(71) Applicant: Woodpeckers, LLC, Strongsville, OH (US)

(72) Inventor: Nathan William Duxbury, Northfield, OH (US)

(73) Assignee: WOODPECKERS, LLC, Strongsville, OH (US)

( * ) Notice: Subject to any disclaimer, the term of this patent is extended or adjusted under 35 U.S.C. 154(b) by 0 days.

(21) Appl. No.: 17/688,008

(22) Filed: Mar. 7, 2022

(65) Prior Publication Data

US 2023/0068817 A1 Mar. 2, 2023

Related U.S. Application Data

(63) Continuation of application No. 17/463,822, filed on Sep. 1, 2021, now Pat. No. 11,485,042.

(51) Int. Cl.
*B27B 27/10* (2006.01)
*B27B 27/04* (2006.01)

(52) U.S. Cl.
CPC ..... *B27B 27/10* (2013.01); *B27B 27/04* (2013.01); *Y10T 83/7593* (2015.04); *Y10T 83/7613* (2015.04); *Y10T 83/8773* (2015.04)

(58) Field of Classification Search
CPC ..... B27B 27/02; B27B 27/04; B27B 27/10; Y10T 83/7697; Y10T 83/7647; Y10T 83/7613; Y10T 83/8773
USPC ..... 269/303, 315
See application file for complete search history.

(56) References Cited

U.S. PATENT DOCUMENTS

| | | | |
|---|---|---|---|
| 1,504,248 | A | 4/1924 | Johnson |
| 2,890,729 | A | 6/1959 | Horn |
| 3,095,673 | A | 7/1963 | Born, Jr. et al. |
| 3,516,316 | A | 4/1968 | Cooper |
| 3,994,484 | A | 11/1976 | Schorr |
| 4,693,158 | A | 9/1987 | Price |
| D298,040 | S | 10/1988 | Legler et al. |

(Continued)

OTHER PUBLICATIONS

"Rockler Inline Track Stop for T Track System—Durable Aluminum T Tracks Woodworking Stop features Low-Profile Knobs—T-Track Stop Msueare . . . " Amazon., Jun. 2, 2015 [online], [retrieved on Jul. 28, 2022]. Retrieved from the Internet <URL: https://www.amazon.com/Rockler-Inline-Stop-T-Track-System/B00YP2M0CU/>.

(Continued)

*Primary Examiner* — Laura M Lee
(74) *Attorney, Agent, or Firm* — Sand, Sebolt & Wemnow Co., LPA

(57) ABSTRACT

A stop assembly may include a first portion configured to selectively operably engage a track of a tool and a stop portion operably engaged with the first portion configured to releasably engage a workpiece. The stop portion may be pivotable between a disengaged position and an engaged position relative to the first portion. The stop portion may move in a rotational direction toward the first portion when moving from the disengaged position to the engaged position. A method of use may include pivoting a stop portion of a stop assembly, about a pivot axis defined by a pivot shaft of the stop assembly, to an engaged position such that the stop portion moves in a rotational direction toward a first portion of the stop assembly.

12 Claims, 14 Drawing Sheets

(56) References Cited

U.S. PATENT DOCUMENTS

| | | | | |
|---|---|---|---|---|
| 4,782,871 | A | 11/1988 | Aigner | |
| 4,901,992 | A | 2/1990 | Dobeck | |
| 4,974,650 | A | 12/1990 | Varley | |
| 5,018,562 | A | 5/1991 | Adams | |
| 5,337,641 | A * | 8/1994 | Duginske | B27B 27/02 33/468 |
| 5,419,540 | A | 5/1995 | Teafatiller | |
| 5,617,909 | A | 4/1997 | Duginske | |
| D387,782 | S | 12/1997 | Letendre | |
| 5,722,308 | A * | 3/1998 | Ceroll | B27B 27/02 144/287 |
| 5,735,324 | A | 4/1998 | Ponce | |
| 5,768,966 | A | 6/1998 | Duginske | |
| 5,768,996 | A | 6/1998 | Ackley | |
| 5,807,036 | A | 9/1998 | Lostlen | |
| 5,816,129 | A * | 10/1998 | Singer | B27B 27/08 83/581 |
| 5,845,555 | A | 12/1998 | Dawley | |
| D404,404 | S | 1/1999 | Lane et al. | |
| D415,177 | S | 10/1999 | Miller et al. | |
| D427,214 | S | 6/2000 | Welsh et al. | |
| D428,899 | S | 8/2000 | Brutscher et al. | |
| 6,293,176 | B1 * | 9/2001 | Talesky | B23D 47/025 144/287 |
| 6,557,601 | B1 | 5/2003 | Taylor | |
| 6,688,202 | B2 | 2/2004 | Parks et al. | |
| 6,880,442 | B2 | 4/2005 | Duginske | |
| D512,893 | S | 12/2005 | Cowan | |
| 7,228,774 | B2 | 6/2007 | Stolzer | |
| 7,231,858 | B2 * | 6/2007 | Oberheim | B23D 47/025 83/522.18 |
| 7,367,253 | B2 | 5/2008 | Romo et al. | |
| 7,416,000 | B2 | 8/2008 | White et al. | |
| 7,464,737 | B2 | 12/2008 | Duginske | |
| 7,483,765 | B2 * | 1/2009 | Dick | B27B 27/10 700/186 |
| 7,798,187 | B1 | 9/2010 | Duginske | |
| 8,495,939 | B2 * | 7/2013 | Kani | B27B 27/08 83/490 |
| D702,532 | S | 4/2014 | Garrido et al. | |
| 8,844,918 | B1 | 9/2014 | Milligan | |
| D754,525 | S | 4/2016 | Kandakur et al. | |
| 9,403,284 | B2 * | 8/2016 | Liu | B23Q 3/005 |
| 9,505,069 | B2 * | 11/2016 | Frolov | B23D 47/025 |
| D808,249 | S | 1/2018 | Kandakur et al. | |
| 9,993,938 | B2 * | 6/2018 | Chen | B25H 1/10 |
| 9,996,072 | B2 | 6/2018 | Dick et al. | |
| 10,092,968 | B2 * | 10/2018 | Fulmer | B23D 45/06 |
| D907,079 | S | 1/2021 | Favel et al. | |
| 10,906,110 | B2 | 2/2021 | Mayer et al. | |
| D915,715 | S | 4/2021 | Berg | |
| 11,020,808 | B2 | 6/2021 | Duginske | |
| 11,345,057 | B1 | 5/2022 | Duxbury | |
| 2002/0092397 | A1 * | 7/2002 | Liu | B23D 47/025 83/477.2 |
| 2004/0124036 | A1 | 7/2004 | Ulshafter, Jr. | |
| 2005/0223862 | A1 * | 10/2005 | Oberheim | B23D 47/025 83/477.2 |
| 2006/0248998 | A1 | 11/2006 | Duginske | |
| 2007/0175729 | A1 | 8/2007 | Robinson et al. | |
| 2008/0041211 | A1 * | 2/2008 | Gibbons | B27G 5/023 33/534 |
| 2012/0167738 | A1 | 7/2012 | Lawlor et al. | |
| 2015/0082962 | A1 * | 3/2015 | Lin | B27B 27/10 83/468.7 |
| 2015/0298273 | A1 | 10/2015 | Suhling | |
| 2020/0215623 | A1 * | 7/2020 | Duginske | B27B 27/00 |
| 2021/0078196 | A1 * | 3/2021 | Pierluigi | B27B 27/10 |
| 2021/0394319 | A1 | 12/2021 | Suhling | |
| 2022/0176580 | A1 | 6/2022 | Ottemeier et al. | |

OTHER PUBLICATIONS

"Powertec 71367 3-Inch Fence Flip Stop for Woodworking" Amazon., May 3, 2019 [online], [retrieved Jul. 28, 2022]. Retrieved from the Internet <URL: https://www.amazon.com/POWERTEC-71367-3-Inch-Fence-Flip/dp/B07RJBCS46/ref=pd_Ipo_3?pd_rd_i=B07RJBCS46&th=1>.

* cited by examiner

FENCE AND STOP ASSEMBLY SYSTEM AND METHOD OF USE THEREOF

CROSS REFERENCE TO RELATED APPLICATION

This application is a Continuation of U.S. patent application Ser. No. 17/463,822, filed Sep. 1, 2021, the entire disclosure of which is incorporated herein by reference.

TECHNICAL FIELD

This disclosure is directed to a fence and stop assembly system. More particularly, this disclosure is directed to a fence and stop assembly system having improved accuracy, consistency, and efficiency. Specifically, this disclosure is directed to a fence and stop assembly system having a fence and a selectively engageable and fine-adjustable stop assembly.

BACKGROUND

Background Information

When undertaking projects, such as, for example, woodworking or metal working projects, a worker may be required to perform repeatable operations on multiple workpieces. For example, a project may require a worker to crosscut multiple workpieces to the same length. As performing repeatable operations on multiple workpieces is typically difficult and time consuming, workers may look for tools to aid the process. However, conventional tools available to workers performing repeatable operations have some drawbacks including, among others, being inaccurate, inconsistent, and inefficient.

SUMMARY

In one aspect, an exemplary embodiment of the present disclosure may provide a fence and stop assembly system, comprising a fence configured to guide and/or secure a workpiece, a track defined in the fence extending along a length thereof, a stop assembly operably engaged with the track, and a stop portion of the stop assembly configured to engage the workpiece. At least a part of the stop portion may be positioned within the track. In some implementations, the entire stop assembly may be positioned between a top end and a bottom end of the fence.

The track may include a front opening, and the stop assembly may include a pivot shaft defining a pivot axis. The stop portion may be pivotable about the pivot axis between a disengaged position and an engaged position. In some implementations, when the stop portion pivots about the pivot axis from the disengaged position to the engaged position, at least a portion of the stop portion may pass through the front opening defined by the track.

The stop portion may include a stop surface configured to engage the workpiece. In some implementations, when the stop portion is in the disengaged position, the stop surface may face the track, and when the stop portion is in the engaged position, the stop surface may face a direction perpendicular to a front opening defined by the track. In some implementations, the stop portion may pivot about the pivot axis 90 degrees or less between the disengaged position and the engaged position.

The stop assembly may further include a locking assembly configured to engage the track and lock at least a part of the stop assembly at a desired location along the track. The stop assembly may further include a fine-adjustment assembly configured to move the stop portion in a linear direction.

The stop assembly may further include a first portion and a second portion operably engaged with the first portion. The locking assembly may be operably engaged with the first portion and the fine-adjustment assembly may be operably engaged with the second portion. In some implementations, the fine-adjustment assembly may be configured to move the second portion in a linear direction relative to the first portion. The stop portion may be operably engaged with the second portion. In some implementations, the fine-adjustment assembly may be configured to move the stop portion in a linear direction relative to the first portion.

In another aspect, an exemplary embodiment of the present disclosure may provide a method, comprising: operably engaging a stop assembly with a track defined in a fence such that at least a part of a stop portion of the stop assembly is positioned within the track. The method may further include moving the stop portion in a linear direction along the track such that the entire stop assembly is positioned between a top end of the fence and a bottom end of the fence when the stop portion moves in the linear direction. The method may further include moving the stop portion in a linear direction along the track such that at least a portion of the stop portion is within the track as the stop portion moves in the linear direction.

The method may further include pivoting the stop portion, about a pivot axis defined by a pivot shaft of the stop assembly, through a front opening defined by the track to position the stop portion in an engaged position. The method may further include pivoting the stop portion, about a pivot axis defined by a pivot shaft of the stop assembly, to an engaged position such that a stop surface of the stop portion faces a direction perpendicular to a front opening defined by the track when the stop portion is in the engaged position. The method may further include pivoting the stop portion, about a pivot axis defined by a pivot shaft of the stop assembly, 90 degrees or less about the pivot axis to an engaged position.

In another aspect, an exemplary embodiment of the present disclosure may provide a fence and stop assembly system and method of use thereof. The fence and stop assembly system may include a fence configured to guide and/or secure a workpiece, and a track defined in the fence extending along a length thereof. The stop assembly may be operably engaged with the track. The stop assembly may include a stop portion configured to engage the workpiece such that at least a part of the stop portion is positioned within the track. The method may include operably engaging a stop assembly with a track defined in a fence such that at least a part of a stop portion of the stop assembly is positioned within the track.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Referring to FIG. 1 through FIG. 15, there is shown a fence and stop assembly system in accordance with one aspect of the present disclosure, generally indicated at 10. As will be described herein, the system 10 may be utilized with a support 12 to improve the accuracy, consistency, and efficiency of performing repeatable operations on workpieces. Although the support 12 is shown as being a table saw table, it is to be understood that the support 12 may be any suitable support, such as, for example, a workbench, platform, or the like.

Figure 1:
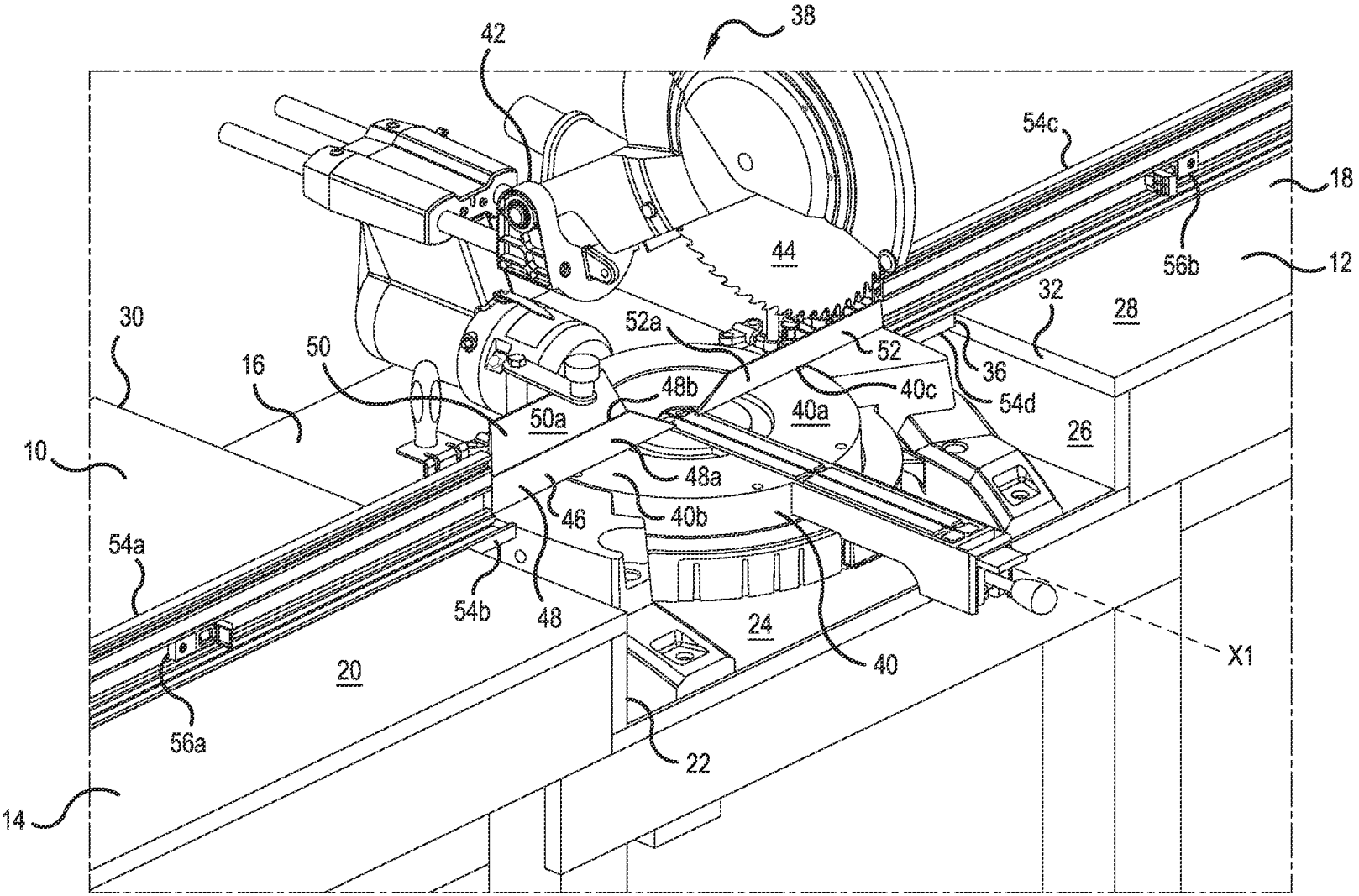
FIG. 1 is a partial perspective environmental view of a fence and stop assembly system being utilized with a miter saw in accordance with one aspect of the present disclosure.

With primary reference to FIG. 1, support 12, which may also be referred to as table 12, may include a first table portion 14, a second table portion 16, and a third table portion 18. As shown in FIG. 1, the second table portion 16 may be positioned intermediate the first table portion 14 and the third table portion 18. The first table portion 14 may include a top surface 20. The second table portion 16 may include a first side surface 22, a top surface 24, and a second side surface 26. The third table portion 18 may include a top surface 28.

With continued reference to FIG. 1, the second table portion 16 may be recessed relative to the first table portion 14 and the third table portion 18. More particularly, the top surface 20 of the first table portion 14 may be coplanar with the top surface 28 of the third table portion 18, and the top surface 24 of the second table portion 16 may be positioned a vertical distance below the top surface 20 of the first table portion 14 and the top surface 28 of the third table portion 18.

The first side surface 22 of the second table portion 16 may extend vertically upward from the top surface 24 of the second table portion 16 to meet the top surface 20 of the first table portion 14 at an edge 30. The top surface 24 of the second table portion 16 may extend between the first side surface 22 and the second side surface 26. The second side surface 26 of the second table portion 16 may extend vertically upward from the top surface 24 of the second table portion 16 to meet the top surface 28 of the third table portion 18 at an edge 32.

Figure 2:
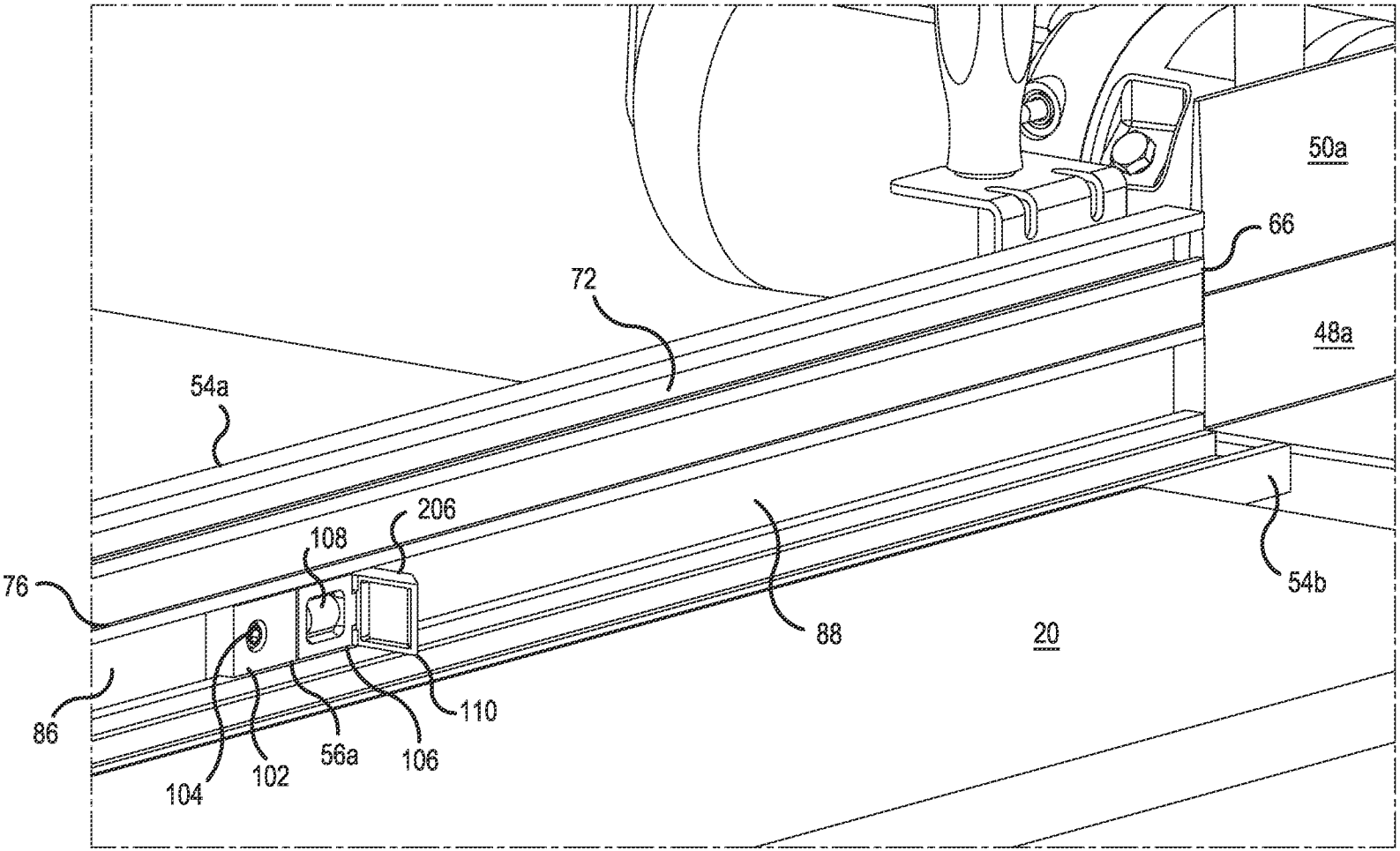
FIG. 2 is a partial, left, front, perspective view of the stop assembly operably engaged within a track of the fence.
Figure 3:
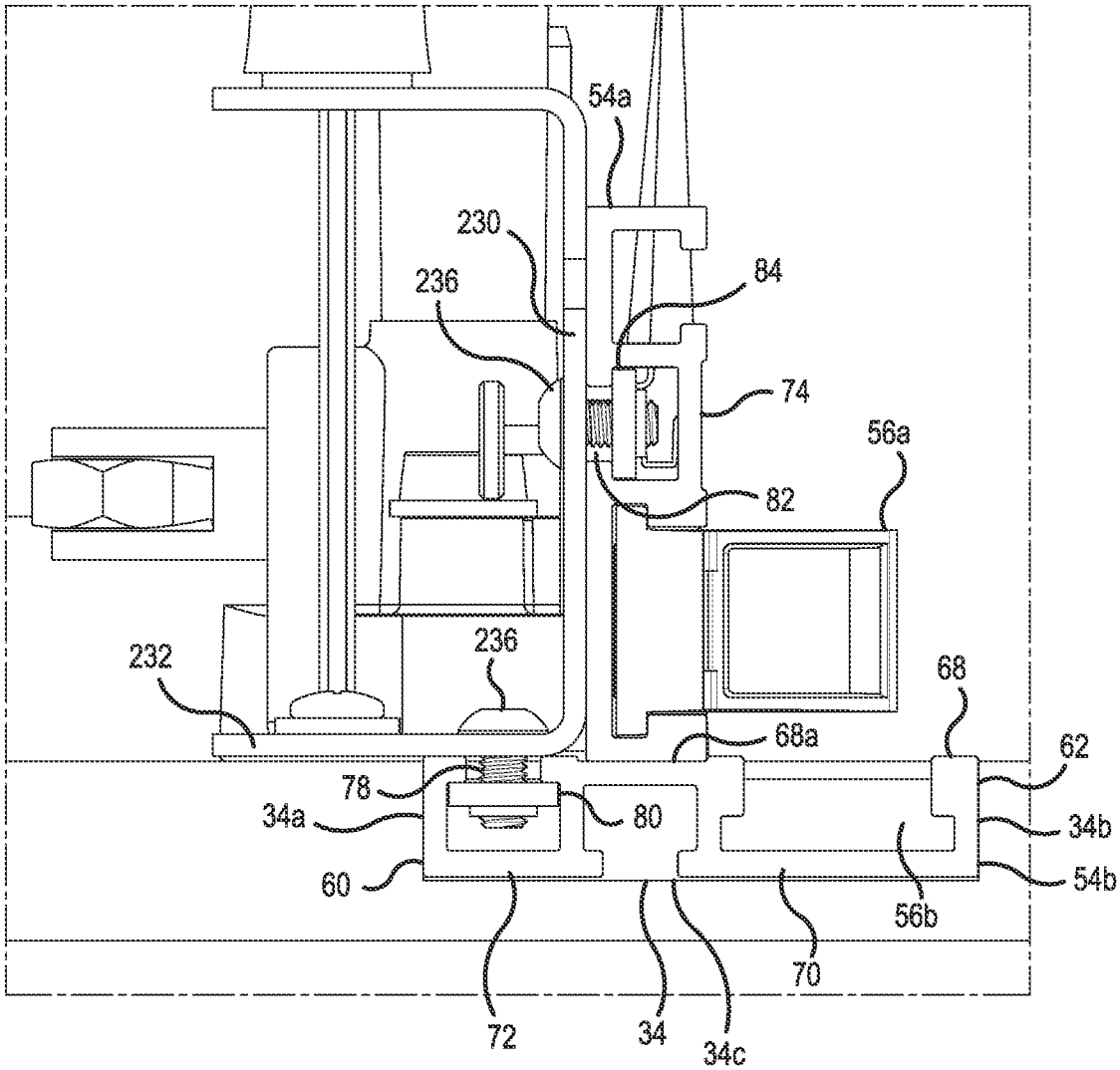
FIG. 3 is a partial, left, elevation view showing a mounting bracket securing fences to a support.

With primary reference to FIG. 1 through FIG. 3, the top surface 20 of the first table portion 14 may define an elongated groove 34 (FIG. 3) extending along a length thereof. The groove 34 may include a first sidewall 34*a*, a second sidewall 34*b*, and a bottom surface 34*c*. The top surface 28 of the third table portion 18 may define a groove 36 extending along a length thereof. The groove 36 of the third table portion 18 may be substantially identical to the groove 34 of the first table portion 14, and, as such, will not be further described herein.

With primary reference to FIG. 1, a machine tool 38, shown as a miter saw in FIG. 1, may be provided on the top surface 24 of the second table portion 16. Although the machine tool 38 has shown as being a miter saw, it is to be understood that the machine tool 38 may be any suitable tool, such as, for example, a chop saw, a drill press, or the like.

With continued reference to FIG. 1, the machine tool 38 may include a base 40, a support member 42, a cutting blade 44, and a saw fence assembly 46. The base 40 may be positioned on the top surface 24 of the second table portion 16 and may include a support surface 40*a*, a first side 40*b*, and a second side 40*c*. The cutting blade 44 may be operatively engaged with the base 40 by the support member 42 and may cut along a cutting axis X1. The saw fence assembly 46 may include a first lower fence 48, an upper fence 50, and a second lower fence 52.

The first lower fence 48 may include a front surface 48*a* and may be an elongate member. The first lower fence 48 may be engaged with the support surface 40*a* of the base 40 proximate the first side 40*b* of the base 40 and spaced a distance from the cutting axis X1 in a direction perpendicular to the cutting axis X1. The front surface 48*a* of the first lower fence 48 may extend vertically upward from the support surface 40*a* of the base 40 such that the front surface 48*a* of the first lower fence 48 faces a direction parallel with the cutting axis X1.

The upper fence 50 may include a front surface 50*a* and may be an elongate member. The upper fence 50 may be engaged with a top 48*b* of the first lower fence 48 and spaced a distance from the cutting axis X1 in a direction perpendicular to the cutting axis X1. The front surface 50*a* of the upper fence 50 may extend vertically upward from the top 48*b* of the first lower fence 48 such that the front surface 50*a* of the upper fence 50 faces a direction parallel with the cutting axis X1. As such, the front surface 48*a* of the first lower fence 48 and the front surface 50*a* of the upper fence 50 may be coplanar in a vertical direction with one another.

The second lower fence 52 may include a front surface 52*a* and may be an elongate member. The second lower fence 52 may be engaged with the support surface 40*a* of the base 40 proximate the second side 40*c* of the base 40 and spaced a distance from the cutting axis X1 in a direction perpendicular to the cutting axis X1. The front surface 52*a* of the second lower fence 52 may extend vertically upward from the support surface 40*a* of the base 40 such that the front surface 52*a* faces a direction parallel with the cutting axis X1. The front surface 52*a* of the second lower fence 52 may be coplanar in a vertical direction with the front surface 48*a* of the first lower fence 48 and the front surface 50*a* of the upper fence 50.

As such, the front surface 48*a* of the first lower fence 48, the front surface 50*a* of the upper fence 50, and the front surface 52*a* of the second lower fence 52 may guide and/or secure a workpiece while it is being worked on, such as, for example, while the workpiece is being sawn, planed, routed, marked, drilled, or the like.

With primary reference to FIG. 1 through FIG. 3, and in some implementations, the system 10 may include a first fence 54*a*, a second fence 54*b*, a third fence 54*c*, a fourth fence 54*d*, a first stop assembly 56*a*, a second stop assembly 56*b*, and a plurality of mounting brackets 58. Although the system 10 will be described herein as being configured to utilize multiple fences, multiple stop assemblies, and multiple mounting brackets, it is to be understood that the system 10 may be configured to utilize any suitable number of fences, stop assemblies, and mounting brackets.

It should be noted that the first fence 54*a*, the second fence 54*b*, the third fence 54*c*, and the fourth fence 54*d* may be substantially identical, and, therefore, only the structure of the first fence 54*a* will be further described herein, and any such descriptions applied to the first fence 54*a* may be applied to the second fence 54*b*, the third fence 54*c*, and the fourth fence 54*d* as necessary.

Figure 10:
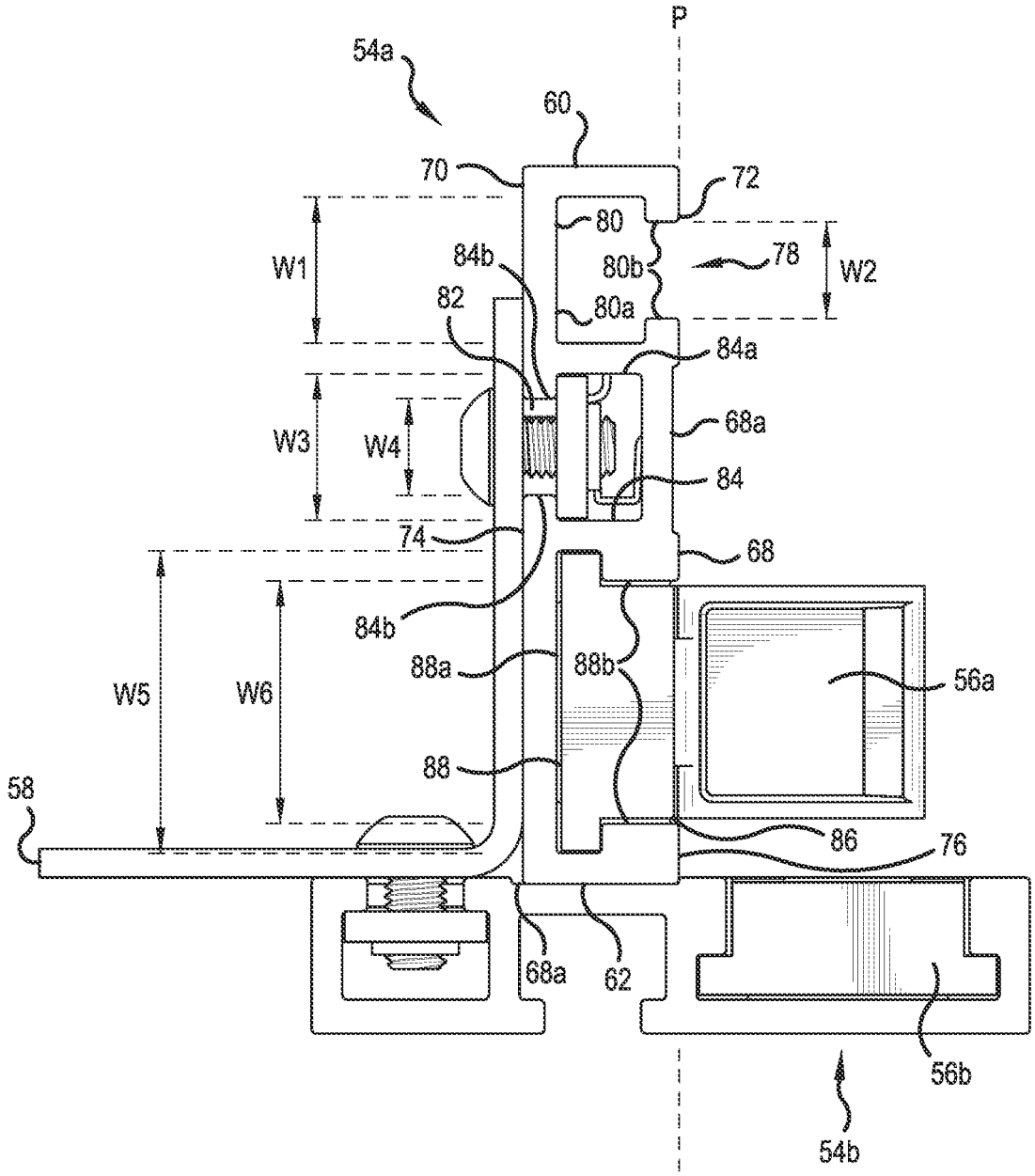
FIG. 10 is a partial, left, elevation view of the mounting brackets, the fences, and the stop assemblies.

With primary reference to FIG. 1 through FIG. 3, FIG. 8, and FIG. 10 through FIG. 11, the first fence 54*a* may include a top end 60 (FIG. 10), a bottom end 62 (FIG. 10), a first end 64 (FIG. 8), a second end 66 (FIG. 2), a first side 68 (FIG. 10), and a second side 70 (FIG. 10). The top end 60 and the bottom end 62 may define a vertical direction therebetween. The first end 64 and the second end 66 may define a longitudinal direction therebetween. The first side 68 and the second side 70 may define a transverse direction therebetween.

With continued reference to FIG. 1 through FIG. 3, FIG. 8, and FIG. 10 through FIG. 11, the first fence 54*a* may be an elongate longitudinally extending member. In some implementations, the first fence 54*a* may be made out of aluminum or metal, however, it is to be understood that the first fence 54*a* may be made out of any suitable material. The first fence 54*a* may be formed with a first track 72, a second track 74, and a third track 76 therein and extending longitudinally between the first end 64 and the second end 66 of the first fence 54*a*.

The first side 68 may include a recessed region 68*a* configured to be engaged with a portion of another fence (e.g., the bottom end 62 of the first fence 54*a* is engaged with the recessed region 68*a* of the first side 68 of the second fence 54*b* as shown in FIG. 10) as more fully described below. The first side 68 may define an imaginary longitudinal vertical plane P (FIG. 10) extending along a length of the first fence 54*a* (as shown in FIG. 10 when looking toward the first end 64 of the first fence 54*a*). Stated otherwise, the imaginary longitudinal vertical plane P may be defined by the first side 68 of the first fence 54*a* and may extend along a length of the first side 68 of the first fence 54*a*.

The first side 68 of the first fence 54*a* may be coplanar with the front surface 48*a* of the first lower fence 48, the front surface 50*a* of the upper fence 50, and the front surface 52*a* of the second lower fence 52. As such, and in some implementations, the second end 66 of the first fence 54*a* may abut the first lower fence 48 and the upper fence 50 of the saw fence assembly 46 to serve as an extension to the saw fence assembly 46. However, in other implementations, the second end 66 of the first fence 54*a* may be placed proximate the machine tool, such as, for example, when a machine tool does not have a fence assembly.

With primary reference to FIG. 10, the first track 72 may be formed in the first fence 54*a* as an elongate longitudinally extending T-track having a first end opening, a second end opening, and a front opening 78, each of which leading to an interior surface 80. The interior surface 80 of the first track 72 may include an elongate base portion 80*a* and an elongate stem portion 80*b*. The base portion 80*a* may have a width W1 and the stem portion 80*b* may have a width W2. In some implementations, width W1 may be greater than width W2, however, width W1 and width W2 may be any suitable dimensions.

With continued reference to FIG. 10, the second track 74 may be formed in the first fence 54*a* as an elongate T-track having a first end opening, a second end opening, and a front opening 82, each of which leading to an interior surface 84. The interior surface 84 of the second track 74 may include an elongate base portion 84*a* and an elongate stem portion 84*b*. The base portion 84*a* may have a width W3 and the stem portion 84*b* may have a width W4. In some implementations, width W3 may be greater than width W4, however, width W3 and width W4 may be any suitable dimensions.

With continued reference to FIG. 10, the third track 76 may be formed in the first fence 54*a* as an elongate T-track having a first end opening, a second end opening, and a front opening 86, each of which leading to an interior surface 88. The interior surface 88 of the third track 76 may include an elongate base portion 88*a* and an elongate stem portion 88*b*. The base portion 88*a* may have a width W5 and the stem portion 88*b* may have a width W6. In some implementations, width W5 may be greater than width W6, however, width W5 and width W6 may be any suitable dimensions.

With continued reference to FIG. 10, the first track 72 may be provided on the first side 68 of the first fence 54*a* proximate the top end 60 of the first fence 54*a* such that the front opening 78 of the first track 72 faces outwardly from the first side 68 of the first fence 54*a*.

The second track 74 may be provided on the second side 70 of the first fence 54*a* such that the front opening 82 of the second track 74 faces outwardly from the second side 70 of the first fence 54*a* and is positioned vertically intermediate the front opening 78 of the first track 72 and the front opening 86 of the third track 76.

The third track 76 may be provided on the first side 68 of the first fence 54*a* proximate the bottom end 62 of the first fence 54*a* such that the front opening 86 of the third track 76 faces outwardly from the first side 68 of the first fence 54*a*.

In some implementations, the first track 72 may be formed to have dimensions corresponding to standard fastener dimensions, the second track 74 may be formed to have dimensions corresponding to standard fastener dimensions, and the third track 76 may be formed to have dimensions corresponding to standard miter gauge dimensions (e.g., ¾ of an inch by ⅜ of an inch). However, the first track 72, the second track 74, and the third track 76 may take on any suitable dimensions. Although the first track 72, the second track 74, and the third track 76 have been described as being elongate longitudinally extending T-tracks, it is to be understood that the first track 72, the second track 74, and the third track 76 may take on any suitable shape and may have any suitable cross section.

It should be noted that the first stop assembly 56*a* and the second stop assembly 56*b* may be substantially identical, and, therefore, only the structure of the first stop assembly 56*a* will be further described herein, and any such descriptions applied to the first stop assembly 56*a* may be applied to the second stop assembly 56*b* as necessary.

With primary reference to FIG. 4 through FIG. 7, the first stop assembly 56*a* may include a top end 90, a bottom end 92, a first end 94, a second end 96, a first side 98, a second side 100, a first portion 102, a locking assembly 104, a second portion 106, a fine-adjustment assembly 108, and a stop portion 110.

For clarity, directions relative to the first stop assembly 56*a* will be defined herein, which may be different compared to the directions defined relative to the first fence 54*a*. As such, the top end 90 (FIG. 6) and the bottom end 92 (FIG. 6) may define a vertical direction therebetween. The first end 94 (FIG. 6) and the second end 96 (FIG. 6) may define a longitudinal direction therebetween. The first side 98 (FIG. 4) and the second side 100 (FIG. 4) may define a transverse direction therebetween. A central longitudinal axis X2 (FIG. 6) may extend between the first end 94 and the second end 96 of the first stop assembly 56*a*. A central transverse axis X3 (FIG. 4) may extend between the first side 98 and the second side 100 of the first stop assembly 56*a*.

Figure 4:
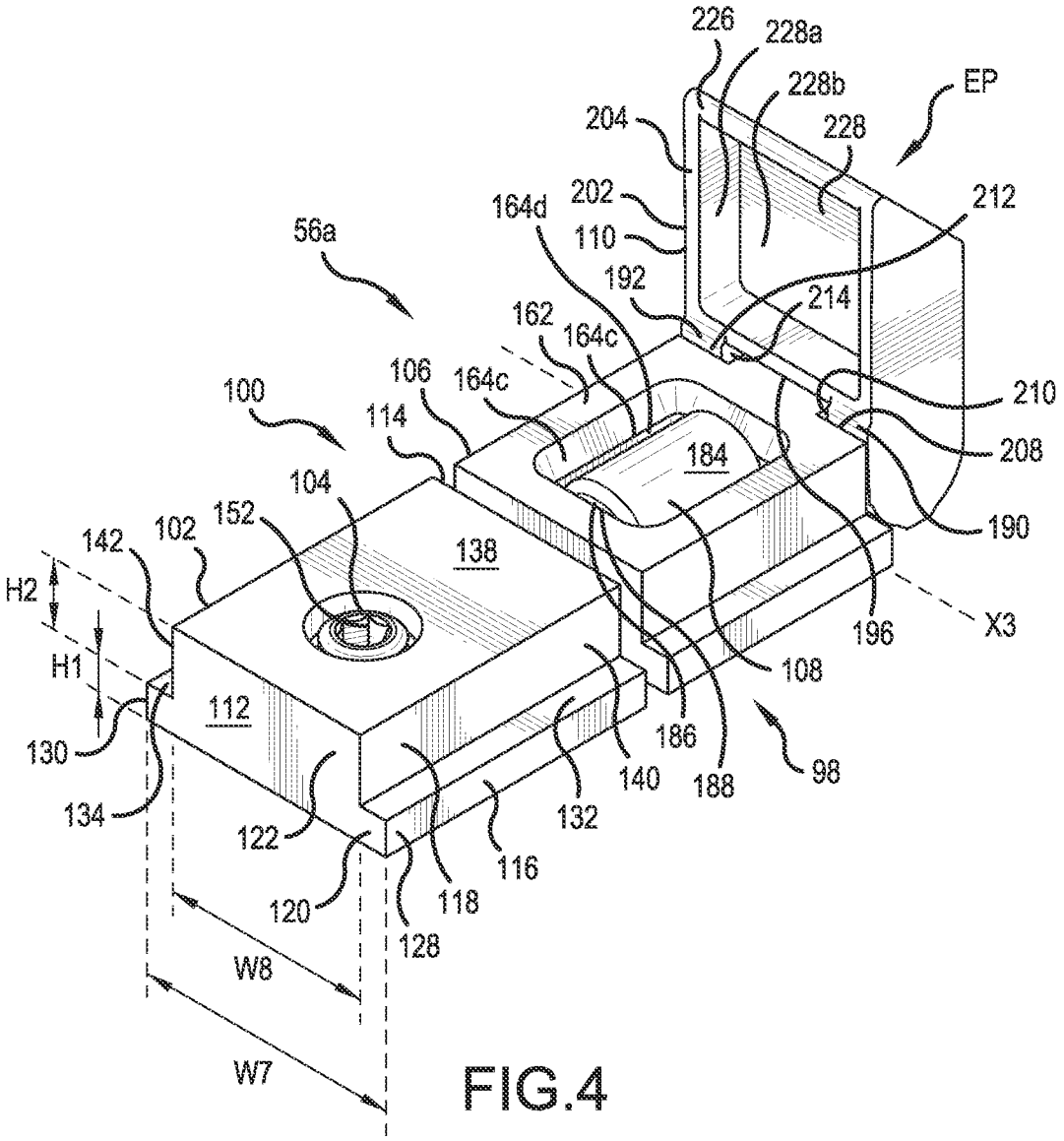
FIG. 4 is a left, front, top, perspective view of the stop assembly.

With primary reference to FIG. 4, the first portion 102 may be a longitudinally extending elongate member having a generally T-shaped cross section. The T-shaped cross section may be conformed to the T-track of the third track 76 formed in the first fence 54*a* such that the first portion 102 may be selectively engaged therein as will be more fully described below. Although the first portion 102 has been described as having a generally T-shaped cross section, it is to be understood that the first portion 102 may take on any suitable shape and may have any suitable cross section.

More particularly, and with continued reference to FIG. 4 through FIG. 7, the first portion 102 may include a first end surface 112, a second end surface 114, a base portion 116, and a stem portion 118. The first end surface 112 may be a vertically extending surface and may face longitudinally outward (i.e., away from the transverse axis X3). The first end surface 112 may include a base region 120 (corresponding to a base of a T-shape as seen looking toward the first end 94 of the first stop assembly 56*a*) and a stem region 122 (corresponding to a stem of a T-shape as seen looking toward the first end 94 of the first stop assembly 56*a*). The base region 120 of the first end surface 112 may be positioned vertically lower than the stem region 122 of the first end surface 112 (corresponding to an upside down T-shape as seen looking toward the first end 94 of the first stop assembly 56*a*). As shown in FIG. 4, the base region 120 of the first end surface 112 may have a transversely extending width W7 and a vertically extending height H1. The stem region 122 of the first end surface 112 may have a transversely extending width W8, and a vertically extending height H2. In some implementations, width W7 may be greater than width W8 and height H1 may be less than height H2, however, width W7, width W8, height H1, and height H2 may be any suitable dimensions.

The second end surface 114 may be a vertically extending surface and may face longitudinally inward (i.e., toward from the transverse axis X3). The second end surface 114 may include a base region 124 (substantially identical to the base region 120 of the first end surface 112) and a stem region 126 (substantially identical to the stem region 122 of the first end surface 112). The base region 124 of the second end surface 114 may be positioned vertically lower than the stem region 126 of the second end surface 114 (in a manner substantially identical to the first end surface 112). As the second end surface 114 may be substantially identical to the first end surface 112, the base region 124 of the second end surface 114 may have a width (not shown) that is equal to width W7 and a height (not shown) that is equal to height H1, and the stem region 126 of the second end surface 114 may have a width (not shown) that is equal to width W8, and a height (not shown) that is equal to height H2.

With continued reference to FIG. 4 through FIG. 7, the base portion 116 may include a first side surface 128, a second side surface 130 (FIG. 8), a first top surface 132, a second top surface 134, a bottom surface 136 (FIG. 6), the base region 120 of the first end surface 112, and the base region 124 of the second end surface 114. The stem portion 118 may include a top surface 138, a first side surface 140, a second side surface 142, the stem region 122 of the first end surface 112, and the stem region 126 of the second end surface 114.

With continued reference to FIG. 4 through FIG. 7, the first side surface 128 of the base portion 116 may be transversely spaced from the second side surface 130 of the base portion 116 a distance equal to width W7. The first side surface 128 of the base portion 116 may face transversely outward (i.e., away from the longitudinal axis X2), may extend longitudinally between the base region 120 of the first end surface 112 and the base region 124 of the second end surface 114, and may extend vertically between the bottom surface 136 of the base portion 116 and the first top surface 132 of the base portion 116 a distance that is equal to height H1.

The second side surface 130 of the base portion 116 may face transversely outward (i.e., away from the longitudinal axis X2), may extend longitudinally between the base region 120 of the first end surface 112 and the base region 124 of the second end surface 114, and may extend vertically between the bottom surface 136 of the base portion 116 and the second top surface 134 of the base portion 116 a distance that is equal to height H1.

The first top surface 132 of the base portion 116 may face vertically upward, may extend transversely between the first side surface 128 of the base portion 116 and the first side surface 140 of the stem portion 118 a distance equal to a difference between width W7 and width W8, and may extend longitudinally between the base region 120 of the first end surface 112 and the base region 124 of the second end surface 114.

The second top surface 134 may face vertically upward, may extend transversely between the second side surface 130 of the base portion 116 and the second side surface 142 of the stem portion 118 a distance equal to a difference between width W7 and width W8, and may extend longitudinally between the base region 120 of the first end surface 112 and the base region 124 of the second end surface 114.

The first side surface 140 of the stem portion 118 may be transversely spaced from the second side surface 142 of the stem portion 118 a distance equal to width W8. The first side surface 140 of the stem portion 118 may face transversely outward (i.e., away from the longitudinal axis X2), may extend vertically between the first top surface 132 of the base portion 116 and the top surface 138 of the stem portion 118 a distance that is equal to height H2, and may extend longitudinally between the stem region 122 of the first end surface 112 and the stem region 126 of the second end surface 114.

The second side surface 142 of the stem portion 118 may face transversely outward (i.e., away from the longitudinal axis X2), may extend vertically between the second top surface 134 of the base portion 116 and the top surface 138 of the stem portion 118 a distance that is equal to height H2, and may extend longitudinally between the stem region 122 of the first end surface 112 and the stem region 126 of the second end surface 114.

The top surface 138 of the stem portion 118 may be spaced a vertical distance from the first top surface 132 of the base portion 116 that is equal to height H2, may extend transversely between the first side surface 140 of the stem portion 118 and the second side surface 142 of the stem portion 118, and may extend longitudinally between the stem region 122 of the first end surface 112 and the stem region 126 of the second end surface 114.

Figure 5:
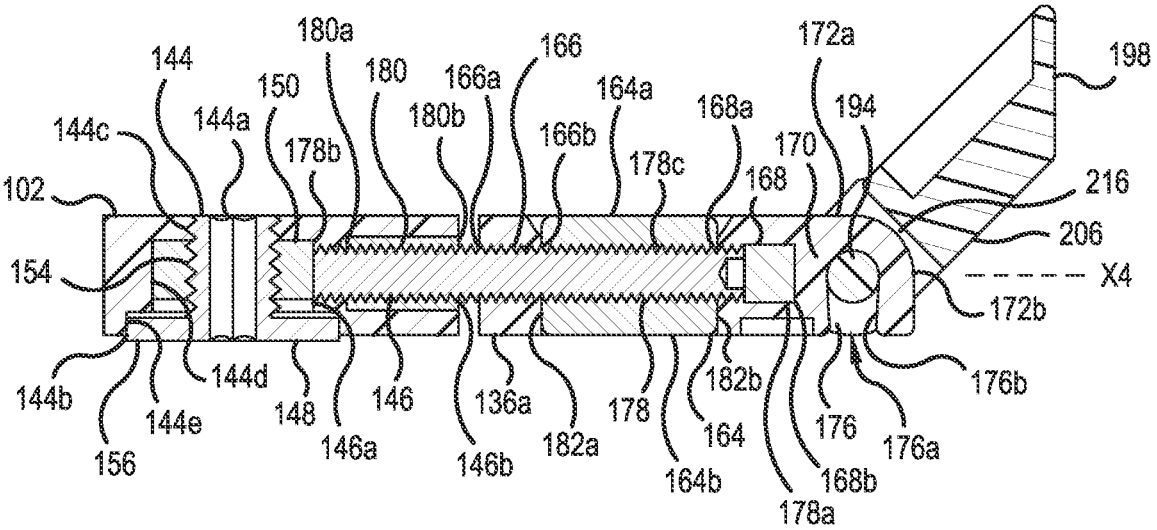
FIG. 5 is a cross section view taken along a central longitudinal axis of the stop assembly.

The first portion 102 may define a vertically extending bore 144 (FIG. 5). More particularly, the bore 144 may extend through the top surface 138 of the stem portion 118 and the bottom surface 136 of the base portion 116. As shown in FIG. 5, the bore 144 may have a varying diameter and may be provided closer to the first end surface 112 than the second end surface 114. However, it is to be understood that the bore 144 may have any suitable diameter (or diameters), and may be provided in any suitable location. With continued reference to FIG. 5, the bore 144 may include a top opening 144*a*, a bottom opening 144*b*, a first bore section 144*c*, a second bore section 144*d*, and a third bore section 144*e* where a diameter of the third bore section 144*e* is greater than a diameter of the second bore section 144*d*, and where the diameter of the second bore section 144*d* is greater than a diameter of the first bore section 144*c*.

With primary reference to FIG. 5, the first portion 102 may define a longitudinally extending bore 146. More particularly, the bore 146 may extend through the second end surface 114 into the second bore section 144*d* of the bore 144. The bore 146 may include a first opening 146*a* and a second opening 146*b* where the first opening 146*a* leads to the bore 144 proximate the second bore section 144*d* of the bore 144 and the second opening 146*b* is sized to receive at least a portion of the fine-adjustment assembly 108 as more fully described below.

With primary reference to FIG. 4 and FIG. 5, the locking assembly 104 may be provided on the first portion 102 and may include a locking foot 148 and a nut 150. The locking foot 148 may include a hex portion 152, a threaded portion 154 and a foot portion 156. As shown in FIG. 5, the nut 150 may be provided within the second bore section 144*d*. The threaded portion 154 may be threadingly engaged with the nut 150 such that the threaded portion 154 is provided within the first bore section 144*c* and the second bore section 144*d*, and the foot portion 156 is provided within the third bore section 144*e*. The hex portion 152 may be accessible through the top opening 144*a* of the bore 144, and the foot portion 156 may be accessible through the bottom opening 144*b* of the bore 144.

As will be described in greater detail below, the locking assembly 104 may be utilized to lock the first portion 102 of the first stop assembly 56*a* in various locations of the third track 76 of the first fence 54*a*. Although the locking assembly 104 has been described as including the locking foot 148 and the nut 150, it is to be understood that other components may be utilized to effect the same result. For example, the locking assembly 104 may include an engagement member, such as, for example, a threaded bolt, configured to releasably secure the first portion 102 with another object, such as, for example, a portion of another tool.

The second portion 106 may be substantially identical to the first portion 102 with several exceptions which will be further described herein. As such, similar parts are labeled with similar reference numerals and different parts are labeled with different reference numerals.

Figure 7:
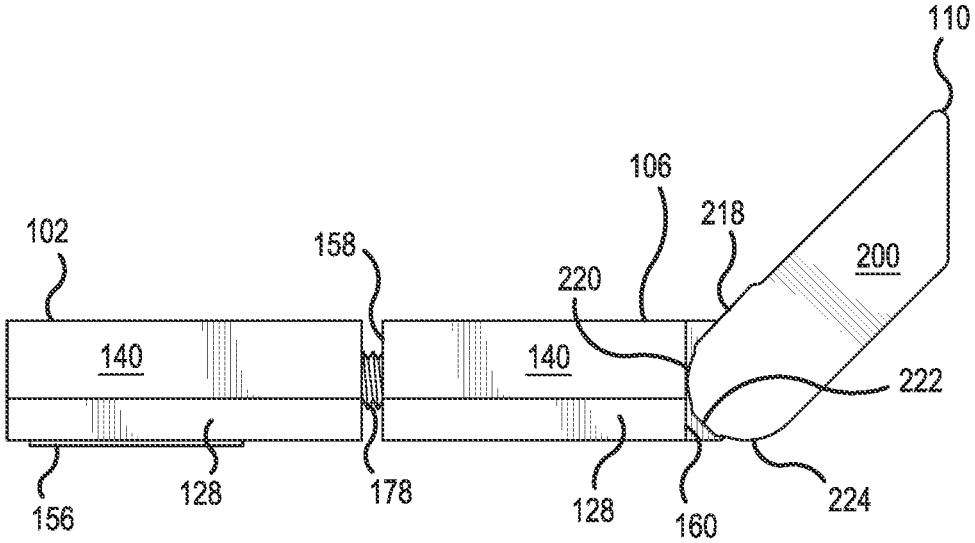
FIG. 7 is a front elevation view of the stop assembly at a midpoint between the disengaged position and an engaged position.

More particularly, and with primary reference to FIG. 4 through FIG. 5 and FIG. 7, a first end surface 158 (FIG. 7) of the second portion 106 is different than the first end surface 112 of the first portion 102, a second end surface 160 (FIG. 7) of the second portion 106 is different than the second end surface 114 of the first portion 102, a top surface 162 (FIG. 4) of the stem portion 118 of the second portion 106 is different than the top surface 138 of the stem portion 118 of the first portion 102, a vertically extending bore 164 (FIG. 5) defined by the second portion 106 is different than the vertically extending bore 144 defined by the first portion 102, a longitudinally extending generally cylindrical bore 166 (FIG. 5) and a longitudinally extending cavity 168 (FIG. 5) defined by the second portion 106 is different than the longitudinally extending bore 146 defined by the first portion 102, and a pivot mount 170 (FIG. 5) is added to the second portion 106, which extends longitudinally away from the second end surface 160 as further described below.

With continued reference to FIG. 4 through FIG. 5 and FIG. 7, the vertically extending bore 164 defined by the second portion 106 may extend through the top surface 162 of the stem portion 118 of the second portion 106 and a bottom surface 136*a* (FIG. 5) of the base portion 116 of the second portion 106, which differs from the bottom surface 136 of the base portion 116 of the first portion 102 in the size and location of the bore 164 compared to the bore 144 of the first portion 102. The bore 164 may be provided generally centrally relative to the top surface 162 of the stem portion 118 of the second portion 106, and may have a varying diameter. However, it is to be understood that the bore 164 may have any suitable diameter (or diameters), and may be provided in any suitable location. More particularly, the bore 164 may include a top opening 164*a*, a bottom opening 164*b*, a first bore section 164*c* and a second bore section 164*d* where a diameter of the first bore section 164*c* tapers downwardly from the top surface 162 and where a diameter of the second bore section 164*d* is equal to a diameter of an edge 164*e* of the first bore section 164*c*.

The longitudinally extending generally cylindrical bore 166 may extend through the first end surface 158 and through the second bore section 164*d* into the bore 164. The bore 166 may include a first opening 166*a* and a second opening 166*b*. The first opening 166*a* of the bore 166 may be provided proximate the first end surface 158, and the second opening 166*b* of the bore 166 may be provided proximate the second bore section 164*d* of the bore 164.

The cavity 168 may extend through the second bore section 164*d*, through the second end surface 160 of the second portion 106, and through at least a part of the pivot mount 170. The cavity 168 may include an opening 168*a* and an end 168*b*. As such, the opening 168*a* of the cavity 168 may lead to the bore 164 and the end 168*b* of the cavity 168 may be provided within at least a part of the pivot mount 170. As shown in FIG. 5, the opening 168*a* of the cavity 168 may be longitudinally aligned with the first opening 166*a* of the bore 166, the second opening 166*b* of the bore 166, the first opening 146*a* of the bore 146 and the second opening 146*b* of the bore 146.

The pivot mount 170 may be engaged with, and may extend longitudinally from, the second end surface 160. More particularly, the pivot mount 170 may include a top surface 172 and a bottom surface 174. The top surface 172 may include a first section 172*a* and a second section 172*b*. The first section 172*a* may be coplanar with the top surface 162 of the stem portion 118 of the second portion 106 and may extend longitudinally away from the second end surface 160 of the second portion 106 toward the second section 172*b* of the top surface 172. The second section 172*b* may extend between the first section 172*a* and the bottom surface 174, and, as such, the second section 172*b* may have an arcuate portion and a straight portion (i.e., the arcuate portion is between the first section 172*a* and the straight portion, and the straight portion is between the arcuate portion and the bottom surface 174). The bottom surface 174 may define a cavity 176 having an opening 176*a* that faces vertically downward and leads to an interior cavity surface 176*b*. As shown in FIG. 5, the cavity 176 may be substantially U-shaped, however, the cavity 176 may take on any suitable shape. The first section 172*a* of the top surface 172 may have a width W9. In some implementations, width W9 may be sized to accommodate at least a portion of the stop portion 110 as more fully described below, however, width W9 may take on any suitable dimension.

With primary reference to FIG. 4 through FIG. 7, the fine-adjustment assembly 108 may include a set screw 178 (FIG. 5), an expansion bolt 180 (FIG. 5), and an adjustment wheel 182 (FIG. 4). The set screw 178 may include a first end 178*a*, a second end 178*b*, and a threaded portion 178*c*. The expansion bolt 180 may be a female threaded bolt and may include a first end 180*a* and a second end 180*b*. The adjustment wheel 182 may include a first end 182*a*, a second end 182*b*, an outer generally cylindrical sidewall 184, and an inner generally cylindrical sidewall 186 (FIG. 5). The inner sidewall 186 may define a threaded bore 188 extending longitudinally through the first end 182*a* and the second end 182*b* of the adjustment wheel 182. The threaded bore 188 may define a thread axis X4, and the adjustment wheel 182 may rotate about the thread axis X4 as more fully described below.

With primary reference to FIG. 5, the set screw 178 may be provided within the first portion 102 and within the second portion 106. More particularly, the first end 178*a* of the set screw 178, which may be a cup point end in one implementation, may contact at least a part of the pivot mount 170 at the end 168*b* of the cavity 168. The threaded portion 178*c* of the set screw 178 may extend from the first end 178*a* of the set screw 178 longitudinally away from the pivot mount 170 along the cavity 168, out of the opening 168*a* of the cavity 168, through a part of the bore 164, threadingly through the threaded bore 188 of the adjustment wheel 182, through a part of the bore 164, through the second opening 166*b* and the first opening 166*a* of the bore 166, through the second opening 146*b* of the bore 146, threadingly through the expansion bolt 180, and through the first opening 146*a* of the bore 146 to contact at least a part of the nut 150.

As such, the adjustment wheel 182 may be provided within the bore 164 and may be rotatable about the thread axis X4. More particularly, the adjustment wheel 182 rotates about the threaded portion 178*c* of the set screw 178 about the thread axis X4. The fine-adjustment assembly 108 may further include an anti-backlash mechanism 182*c*, such as a spring molded within the second portion 106 proximate the first end 182*a* of the adjustment wheel 182, to reduce and/or prevent backlash associated with the linear movement of the second portion 106 and the stop portion 110. In some implementations, the fine-adjustment assembly 108 may be used to make adjustments of thousandths of an inch to the location of the second portion 106, the stop portion 110, and the stop surface 206 of the stop portion 110, however, the range of adjustment of the fine-adjustment assembly 108 may be any suitable range of adjustment.

Although the fine-adjustment assembly 108 has been described as including the set screw 178, the expansion bolt 180, and the adjustment wheel 182, it is to be understood that other components may be utilized to effect the same result. For example, the first portion 102 may be engaged with the second portion 106 with a link member, such as an elongate rod, and the second portion 106 may include an adjustment member, such as, for example, a grip member configured to be gripped by an operator to slidably move the second portion 106 along the elongate rod to make adjustments to components of the first stop assembly 56*a*.

With primary reference to FIG. 4 through FIG. 7, the stop portion 110 may include a first pivot portion 190, a second pivot portion 192, a pivot shaft 194 (FIG. 5), a first end surface 196 (FIG. 6), a second end surface 198, a first side surface 200, a second side surface 202, a top surface 204, and a stop surface 206.

With continued reference to FIG. 4 through FIG. 7, the first pivot portion 190 may include a pivot surface 208 and an inner side surface 210. The second pivot portion 192 may include a pivot surface 212 and an inner side surface 214. The inner side surface 210 of the first pivot portion 190 and the inner side surface 214 of the second pivot portion 192 may be transversely spaced from one another and may extend longitudinally away from the first end surface 196 of the stop portion 110.

The pivot shaft 194 may extend in a transverse direction and may be engaged with the inner side surface 210 of the first pivot portion 190 on one end and the inner side surface 214 of the second pivot portion 192 on the other end at a longitudinal distance away from the first end surface 196. A void 216 may be defined by a portion of the inner side surface 210 of the first pivot portion 190, a portion of the first end surface 196, a portion of the inner side surface 214 of the second pivot portion 192, and a portion of the pivot shaft 194. The pivot shaft 194 may define a pivot axis X5 (FIG. 6) defined by the pivot shaft 194. More particularly, the stop portion 110 may be pivotable about the pivot axis X5 between an engaged position "EP" (FIG. 4) and a disengaged position "DP" (FIG. 6) as will be more fully described below.

It should be noted that the pivot surface 208 of the first pivot portion 190 and the pivot surface 212 of the second pivot portion 192 may be substantially identical, and, therefore, only the pivot surface 208 of the first pivot portion 190 will be further described herein, and any such descriptions applied to the pivot surface 208 of the first pivot portion 190 may be applied to the pivot surface 212 of the second pivot portion 192 as necessary.

Figure 6:
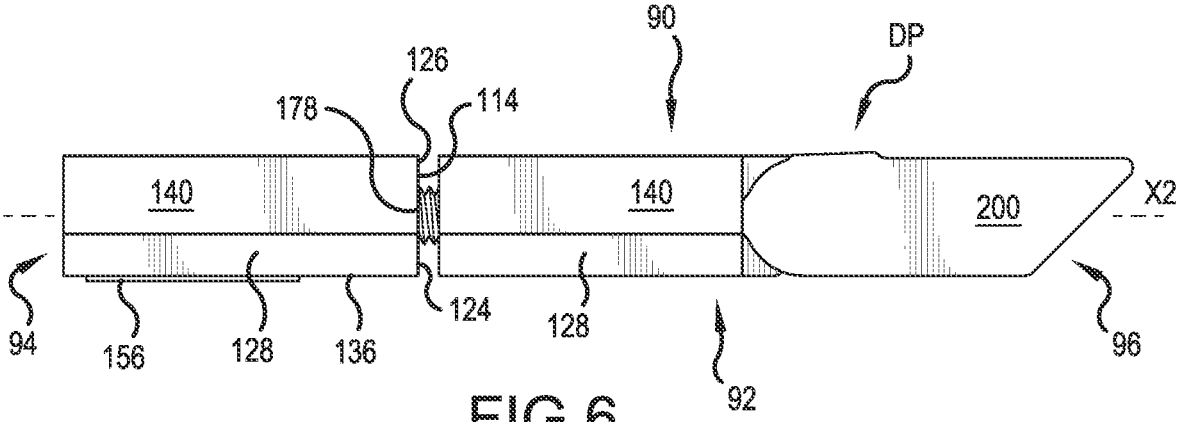
FIG. 6 is a front elevation view of the stop assembly in a disengaged position.

With primary reference to FIG. 4 and FIG. 6 through FIG. 7, the pivot surface 208 of the first pivot portion 190 may be bounded by a part of the inner side surface 210 of the first pivot portion 190, a part of the first side surface 200, a part of the top surface 204, and a part of the stop surface 206. Stated otherwise, the pivot surface 208 of the first pivot portion 190 may extend away from a part of the top surface 204 in a generally arcuate manner between a part of the inner side surface 210 of the first pivot portion 190 and a part of the first side surface 200 until meeting a part of the stop surface 206.

With primary reference to FIG. 7, the pivot surface 208 may include a first section 218, a second section 220, a third section 222, and a fourth section 224. More particularly, the first section 218 may be a generally flat surface provided proximate the top surface 204. When the first stop assembly 56*a* is viewed from the first side 98 (e.g., similar to the view in FIG. 6), the first section 218 may be generally coplanar with, or slightly vertically above, the top surface 162 of the stem portion 118 of the second portion 106 and vertically above the top surface 204 of the stop portion 110. Although vertical heights of the first section 218, the top surface 162 of the stem portion 118 of the second portion 106, and the top surface 204 of the stop portion 110 have been described relative to one another, the first section 218, the top surface 162 of the stem portion 118 of the second portion 106, and the top surface 204 of the stop portion 110 may take on any suitable heights.

The second section 220 may be a generally arcuate surface (such as, for example, a cam surface having convex and/or concave portions) extending between the first section 218 and the third section 222. The third section 222 may be a generally flat surface extending between the second section 220 and the fourth section 224. The fourth section 224 may be a generally arcuate surface (such as, for example, a cam surface having convex and/or concave portions) extending between the third section 222 and a part of the stop surface 206. The configuration of the first section 218, the second section 220, the third section 222, and the fourth section 224 may aid the movement of the stop portion 110 into and out of the engaged position EP and the disengaged position DP.

More particularly, when the stop portion 110 is in the disengaged position DP, the third section 222 (i.e., the generally flat surface) may be engaged with the second end surface 160 of the second portion 106. The stop portion 110 may pivot (about the pivot axis X5) in a rotational direction toward the first portion 102 when moving from the disengaged position DP to the engaged position EP. As this occurs, the second section 220 (i.e., the cam surface) cammingly engages the second end surface 160 of the second portion 106 to aid the rotation of the stop portion 110 until the first section 218 (i.e., the generally flat surface) engages the second end surface 160 of the second portion 106.

Further, when the stop portion 110 is in the engaged position EP, the first section 218 (i.e., the generally flat surface) may be engaged with the second end surface 160 of the second portion 106. The stop portion 110 may pivot (about the pivot axis X5) in a rotational direction away the first portion 102 when moving from the engaged position EP to the disengaged position DP. As this occurs, the second section 220 (i.e., the cam surface) cammingly engages the second end surface 160 of the second portion 106 to aid the rotation of the stop portion 110 until the third section 222 (i.e., the generally flat surface) engages the second end surface 160 of the second portion 106.

With continued reference to FIG. 4 through FIG. 7, the first side surface 200 may face transversely outward (i.e., away from the longitudinal axis X2) and may be bounded by a part of the second end surface 198, a part of the top surface 204, a part of the stop surface 206, and a part of the pivot surface 208 proximate the first side 98 of the first stop assembly 56*a*.

The second side surface 202 may face transversely outward (i.e., away from the longitudinal axis X2) and may be bounded by a part of the second end surface 198, a part of the top surface 204, a part of the stop surface 206, and a part of the pivot surface 212 proximate the second side 100 of the first stop assembly 56*a*.

Further, the second side surface 202 may be spaced a transverse distance away from the first side surface 200 that is that is equal to width W8. Stated otherwise, the stop portion 110 may have a width (not shown) that is equal to (or less than) width W8, which allows at least a part of the stop portion 110 to pass through the front opening 86 of the third track 76.

The second end surface 198 may be bounded by a part of the top surface 204, a part of the stop surface 206, a part of the first side surface 200, and a part of the second side surface 202. The second end surface 198 may be an angled surface extending upwardly from the stop surface 206 at an acute angle relative to the stop surface.

With primary reference to FIG. 4, the top surface 204 may include a perimeter region 226 and a recessed region 228. The recessed region 228 may include a sidewall 228*a* and a bottom surface 228*b*. The sidewall 228*a* may extend away from the perimeter region 226 toward the bottom surface 228*b*. The first pivot portion 190 and the second pivot portion 192 may be engaged with a portion of the perimeter region 226.

The stop surface 206 may be a generally flat surface, and may be bounded by a part of the first pivot portion 190, a part of the second pivot portion 192, a part of the first end surface 196, a part of the second end surface 198, a part of the first side surface 200, and a part of the second side surface 202.

In some implementations, the stop surface 206 may have a length (not shown) defined between the first end surface 196 and the second end surface 198 and a width (not shown) defined between the first side surface 200 and the second side surface 202. The width of the stop surface 206 may be equal to (or less than) width W8, which allows at least a part of the stop surface 206 to pass through the front opening 86 of the third track 76. In some implementations, the stop surface 206 may be square in shape (i.e., the length and width of the stop surface 206 may be equal), however, it is to be understood that the stop surface 206 may take on any suitable dimensions.

As stated above, and as illustrated in FIG. 1 through FIG. 3, the system 10 may utilize four fences (i.e., the first fence 54*a*, the second fence 54*b*, the third fence 54*c*, and the fourth fence 54*d*), where the first fence 54*a*, and the second fence 54*b* are engaged with the top surface 20 of the first table portion 14, and where the third fence 54*c* and the fourth fence 54*d* are engaged with the top surface 28 of the third table portion 18 in a substantially identical manner. As such, only the engagement of the first fence 54*a* and the second fence 54*b* with the top surface 20 of the first table portion 14 will be described herein. However, any such descriptions may be applied to the engagement of the third fence 54*c* and the fourth fence 54*d* with the top surface 28 of the third table portion 18 as necessary.

Figure 11:
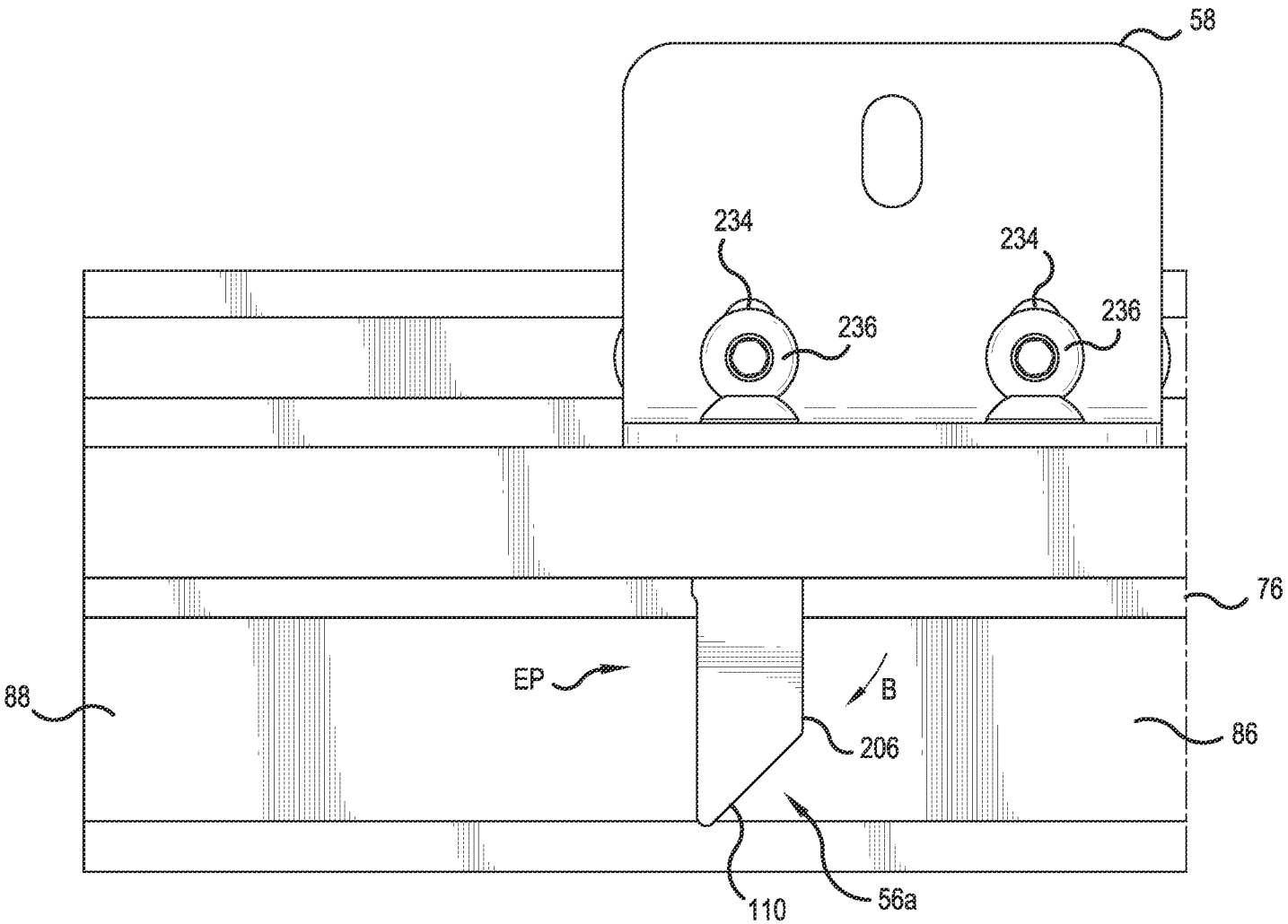
FIG. 11 is a partial, top, plan view showing the stop assembly in the engaged position.
Figure 12:
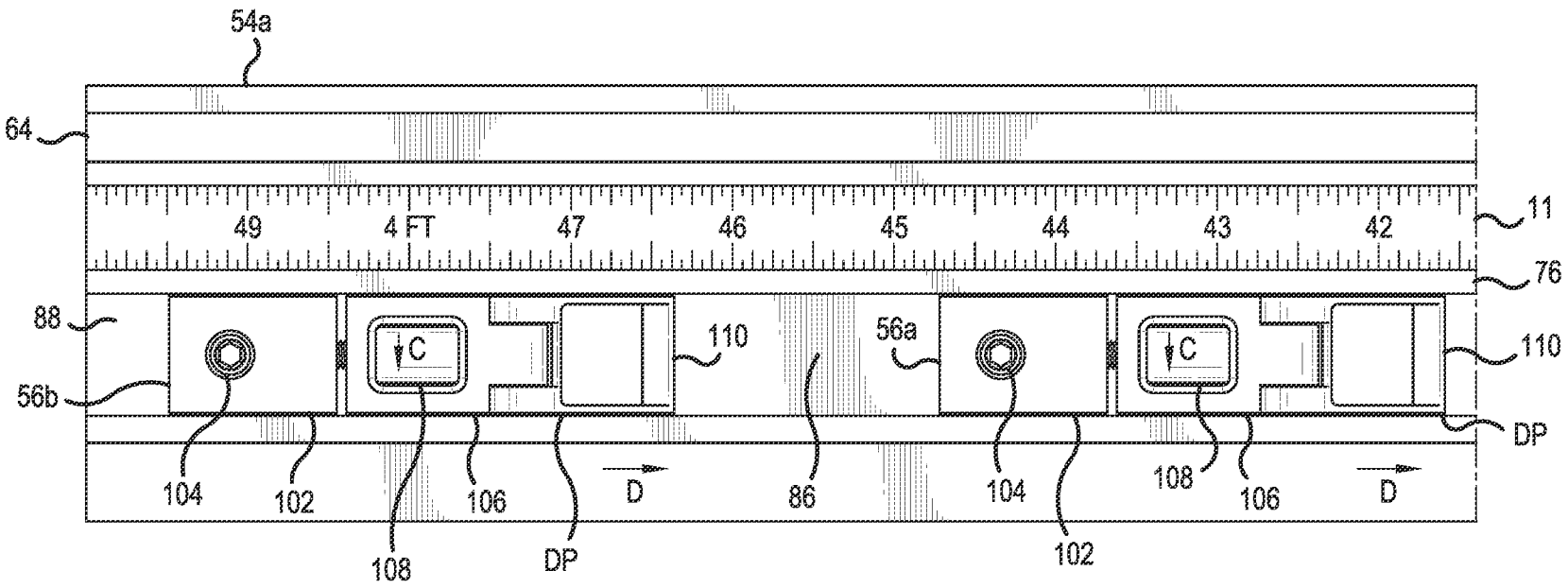
FIG. 12 is a partial, front, elevation view showing two stop assemblies operably engaged within the track of the fence at different locations.

With primary reference to FIG. 3 and FIG. 10 through FIG. 11, each of the plurality of mounting brackets 58 may be L-shaped members including a first mount portion 230 and a second mount portion 232. A plurality of bores 234 (FIG. 11) may be defined in the first mount portion 230 (FIG. 3) and the second mount portion 232 (FIG. 3) of each of the plurality of mounting brackets 58. In some implementations, a plurality of fasteners 236 may extend through the plurality of bores 234 to releasably engage the first fence 54*a* with the second fence 54*b* and the top surface 20 of the first table portion 14 as more fully described below.

With continued reference to FIG. 3 and FIG. 10 through FIG. 11, the second fence 54*b* may be provided within the groove 34 such that the top end 60 is positioned proximate the first sidewall 34*a* of the groove 34, the second side 70 is positioned proximate the bottom surface 34*c* of the groove 34, and the bottom end 62 is positioned proximate the second sidewall 34*b* of the groove. The first fence 54*a* may be provided such that the bottom end 62 of the first fence 54*a* releasably engages the recessed region 68*a* of the first side 68 of the second fence 54*b*.

With continued reference to FIG. 3 and FIG. 10 through FIG. 11, the plurality of mounting brackets 58 may be aligned with the first fence 54*a* and the second fence 54*b* such that one or more of the plurality of bores 234 defined in the first mount portion 230 is aligned with the front opening 82 of the second track 74 of the first fence 54*a* and one or more of the plurality of bores 234 defined in the second mount portion 232 is aligned with the front opening 78 of the first track 72 of the second fence 54*b*.

One or more fasteners 236 may extend through one or more of the plurality of bores 234 such that a portion of the one or more fasteners 236 engages at least the interior surface 84 of the second track 74 of the first fence 54*a*, the interior surface 80 of the first track 72 of the second fence 54*b*, and the top surface 20 of the first table portion 14 thereby releasably engaging the first fence 54*a* and the second fence 54*b* with one another, and further releasably engaging the first fence 54*a* and the second fence 54*b* to the top surface 20 of the first table portion 14.

Although the system 10 has been described as releasably engaging the first fence 54*a* and the second fence 54*b* with one another, and further releasably engaging the first fence 54*a* and the second fence 54*b* to the top surface 20 of the first table portion 14, it is to be understood that other configurations are possible. For example, and in some implementations, the system 10 may utilize a single vertical fence releasably engaged with the table 12 (e.g., if there is no groove 34, the first fence 54*a* may be releasably engaged with the top surface 20 of the first table portion 14), or the system may utilize a single horizontal fence releasably engaged with the groove 34 of the table 12 (e.g., if there is a groove 34, the second fence 54*b* may be releasably engaged with groove 34 in any suitable manner).

It should further be noted that the second end 66 of the first fence 54*a* and the second end 66 of the second fence 54*b* may be positioned to serve as an extension to another fence assembly, such as, for example, a miter saw fence assembly, or, alternatively, positioned proximate a cutting blade of a machine tool, such as, for example, a cutting blade of a miter saw.

Figure 8:
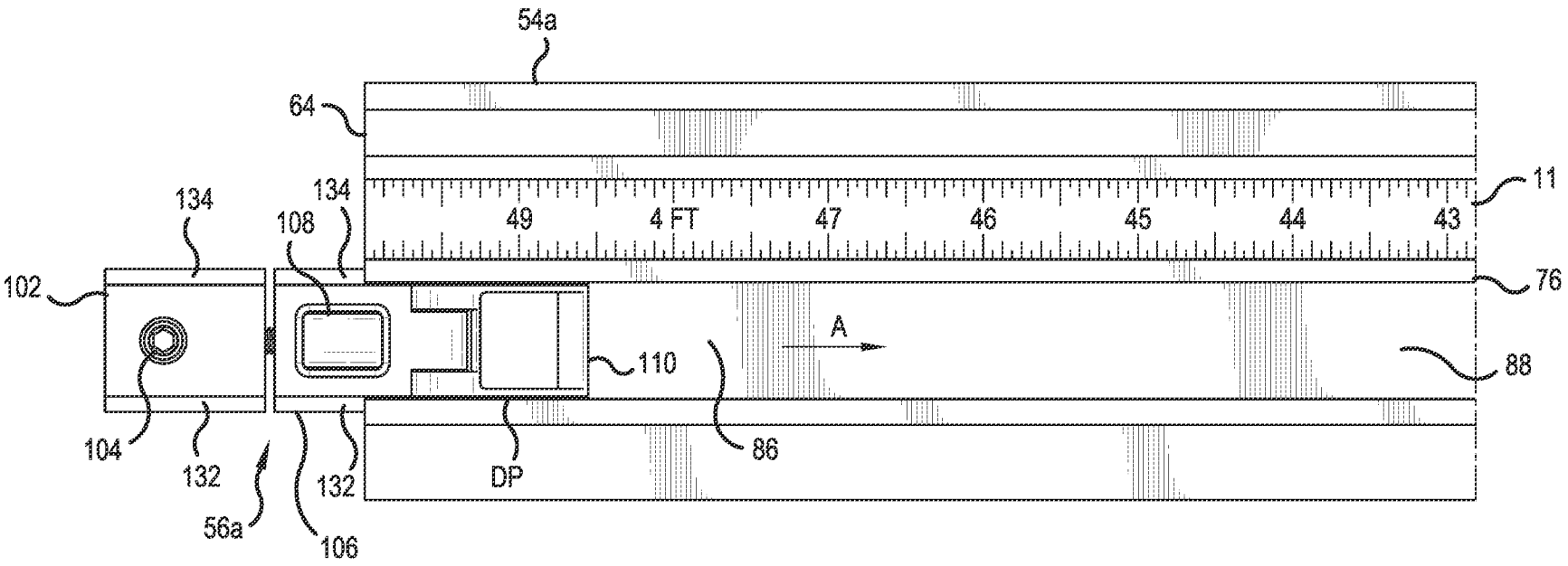
FIG. 8 is a partial, front, operational view showing the stop assembly being operably engaged with the track of the fence.

Having thus described the structure of the system 10, and its associated components, primary reference is now made to FIG. 8 through FIG. 15 to depict one exemplary implementation and operation of the system 10. In this implementation, the system 10 will be described as utilizing two fences, two stop assemblies, and multiple mounting brackets to measure lengths of workpieces to be cut by the cutting blade 44. As shown in FIG. 8, a measurement device 11, such as a ruler, may be engaged with the first fence 54*a* to measure a distance from the cutting blade 44.

With primary reference to FIG. 8, the first stop assembly 56*a* may be inserted within the third track 76 of the first fence 54*a*. It should be noted that the stop portion 110 of the first stop assembly 56*a* may be in either the disengaged position DP or the engaged position EP when being inserted into the first fence 54*a*.

As shown in FIG. 8, the first stop assembly 56*a* is in the disengaged position DP. The first stop assembly 56*a* may be inserted within the third track 76 such that the stop surface (not shown in FIG. 8) of the stop portion 110 faces the interior surface 88 of the third track 76 and the second end 96 of the first stop assembly 56*a* is the first part of the first stop assembly 56*a* to enter the third track 76. It should be noted that in some implementations, when the first stop assembly 56*a* is in the disengaged position DP, the entirety of the first stop assembly 56*a* may be positioned within the track and coplanar with, or inwardly of, the imaginary longitudinal vertical plane P. This is beneficial as no portion of the first stop assembly 56*a* extends into a working area proximate the first fence 54*a*.

As the first stop assembly 56*a* is inserted into the third track 76, the first top surface 132 of the base portion 116 of the first portion 102 and the second portion 106, and the second top surface 134 of the base portion 116 of the first portion 102 and the second portion 106 slidably engage the interior surface 88 of the third track 76 (i.e., an area of the base portion 88*a* of the interior surface 88 is engaged). As shown in FIG. 8, the stop portion 110 may be accessible through the front opening 86 of the third track 76.

Figure 9:
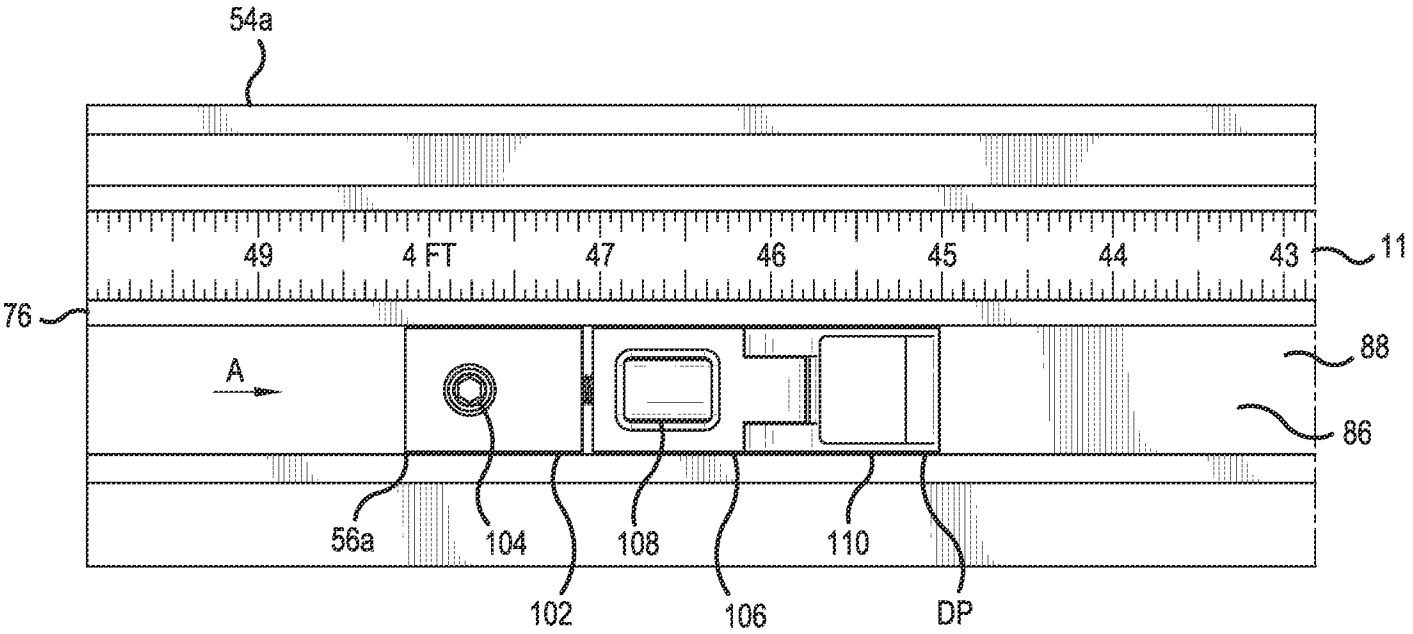
FIG. 9 is a partial, front, operational view showing the stop assembly being slidably moved along the track to a desired location.

With primary reference to FIG. 8 and FIG. 9, the first stop assembly 56*a* may be slidably moved in a direction generally indicated at arrow "A" to a desired location along the third track 76, which, in this implementation, is a location proximate to where the stop surface 206 of the stop portion 110 needs to be when the stop portion 110 is in the engaged position EP (i.e., the 45-inch mark on the measurement device 11).

Once the first stop assembly 56*a* is moved to a location near the desired location, the hex portion 152 may be rotated which, in turn, rotates the threaded portion 154, which, in turn, moves the foot portion 156 in a transverse direction until the foot portion 156 engages the interior surface 88 of the third track 76. This causes the first top surface 132 of the base portion 116 of the first portion 102 and the second portion 106, and the second top surface 134 of the base portion 116 of the first portion 102 and the second portion 106 to engage the interior surface 88 of the third track 76 with sufficient force to lock the first portion 102 of the first stop assembly 56*a* in that location.

With primary reference to FIG. 11, the first stop assembly 56*a* may be moved from its disengaged position DP to its engaged position EP by pivoting the stop portion 110 (in a direction generally indicated at arrow "B") through the front opening 86 of the third track 76 until the stop portion 110 is substantially perpendicular, or perpendicular, to at least the first portion 102, the second portion 106, or the front opening 86 of the third track 76. Although the stop surface 206 of the stop portion 110 is shown as being a flat surface, it is to be understood that the stop surface may take on any suitable shape and/or configuration. In some implementations, the stop portion 110 may pivot about the pivot axis X5 90 degrees or less between the disengaged position DP and the engaged position EP. However, it is to be understood that the stop portion 110 may have any suitable range of rotation.

Figure 13:
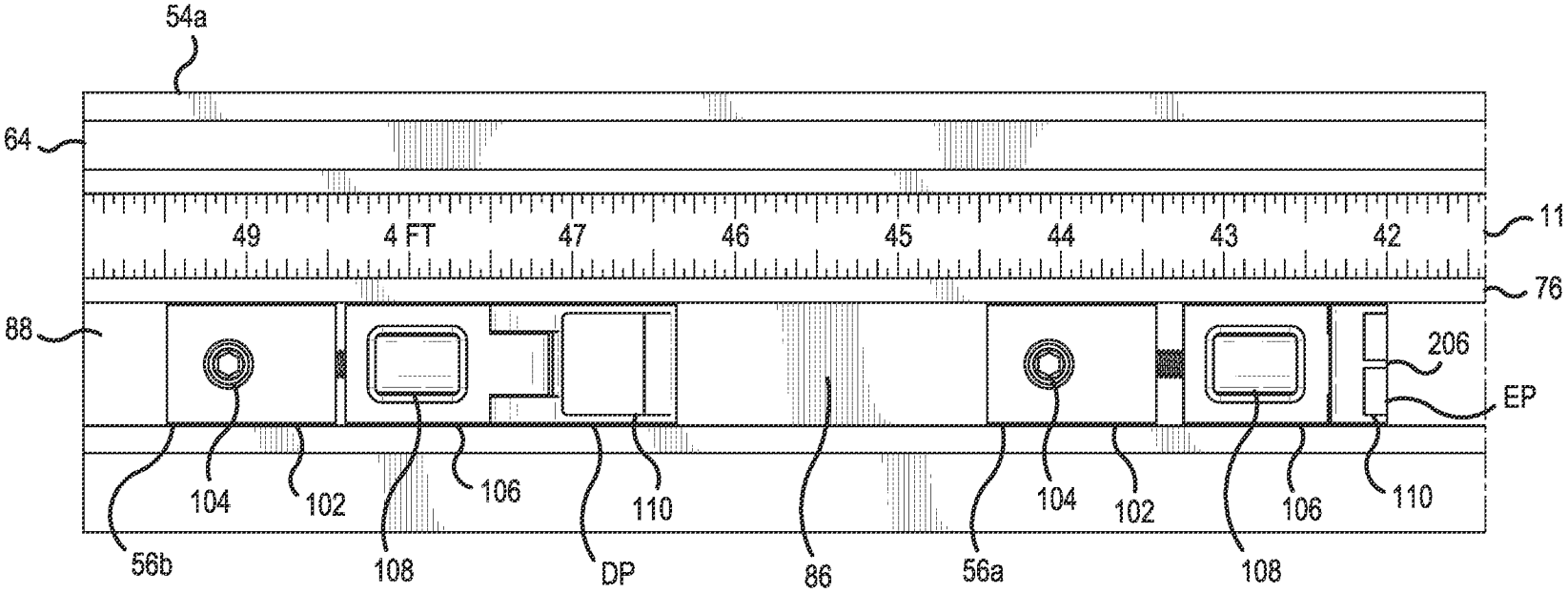
FIG. 13 is a partial, front, elevation view showing two stop assemblies where a stop portion of one of the stop assemblies has been fine-tuned from a first location to a second location along the track of the fence.

Now that the movement of the first stop assembly 56*a* relative to the first fence 54*a* has been described, an implementation showing the first stop assembly 56*a* and the second stop assembly 56*b* engaged with the first fence 54*a* will be described. With primary reference to FIG. 12 through FIG. 15, the first stop assembly 56*a* and the second stop assembly 56*b* are located at a position near a desired location of the stop surface 206 of the stop portion 110. More particularly, and in this implementation, the first stop assembly 56*a* is not at the desired location (i.e., the desired location of the stop surface 206 of the stop portion 110 is the 42-inch mark on the measurement device 11 as shown in FIG. 13), and second stop assembly 56*b* is not at the desired location (i.e., the desired location of the stop surface 206 of the stop portion 110 is the 47-inch mark on the measurement device 11 as shown in FIG. 15). As the first stop assembly 56*a* is not at the desired location, the fine-adjustment assembly 108 may be utilized to move the first stop assembly 56*a* to the desired location as more fully explained below.

With primary reference to FIG. 12 through FIG. 15, and in some implementations, the stop portion 110 may be pivoted from the disengaged position DP to the engaged position EP, and, when this occurs, the stop surface 206 of the stop portion 110 may be at a distance greater than the desired location (e.g., the 42-inch mark and the 47-inch mark). In order for the stop surface 206 of the stop portion 110 of the first stop assembly 56*a* to be positioned at the 42-inch mark, and in order for the stop surface 206 of the stop portion 110 of the second stop assembly 56*b* to be positioned at the 47-inch mark, the stop portion 110 needs to move in a linear direction (e.g., a longitudinal direction) as more fully described herein.

To accomplish this, the adjustment wheel 182 may be rotated in a direction generally indicated at arrow "C" which, in turn, causes the second portion 106 and the stop portion 110 to move in a linear direction (e.g., a longitudinal direction) generally indicated at arrow "D" away from the first portion 102.

Figure 14:
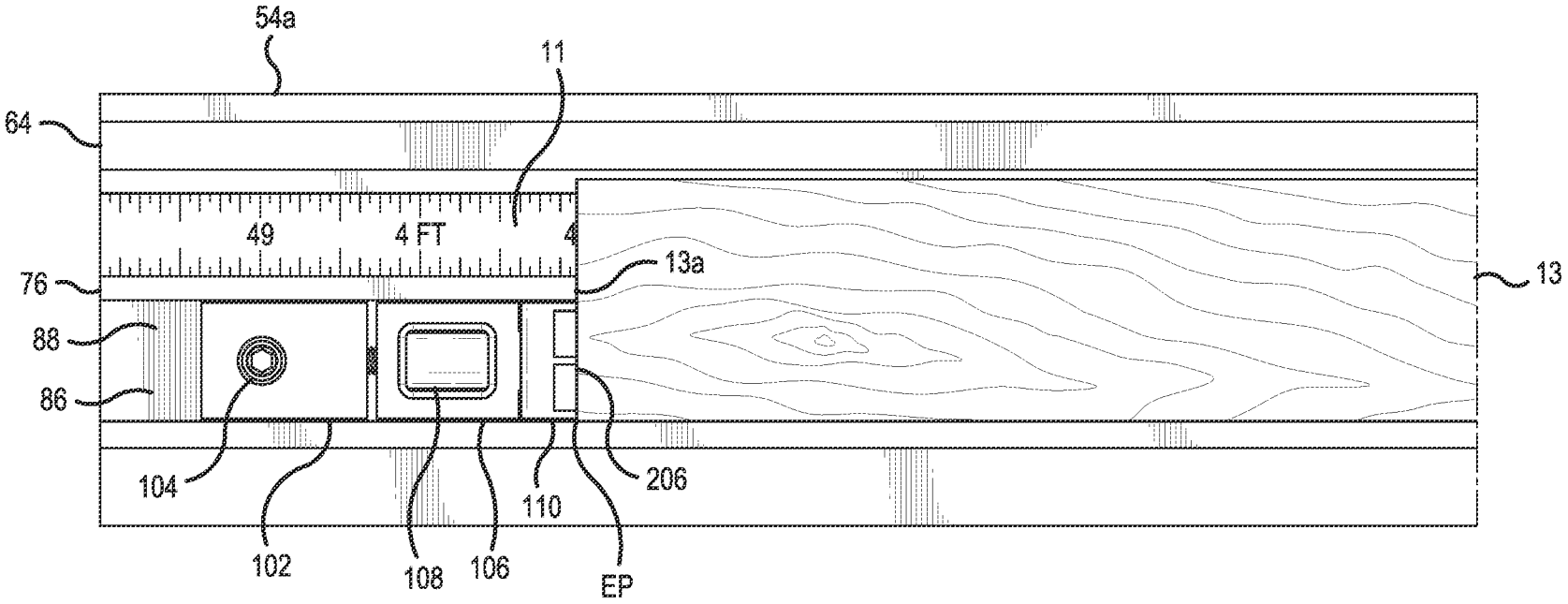
FIG. 14 is a partial operational view showing a workpiece engaging a stop assembly at a distance from the miter saw.
Figure 15:
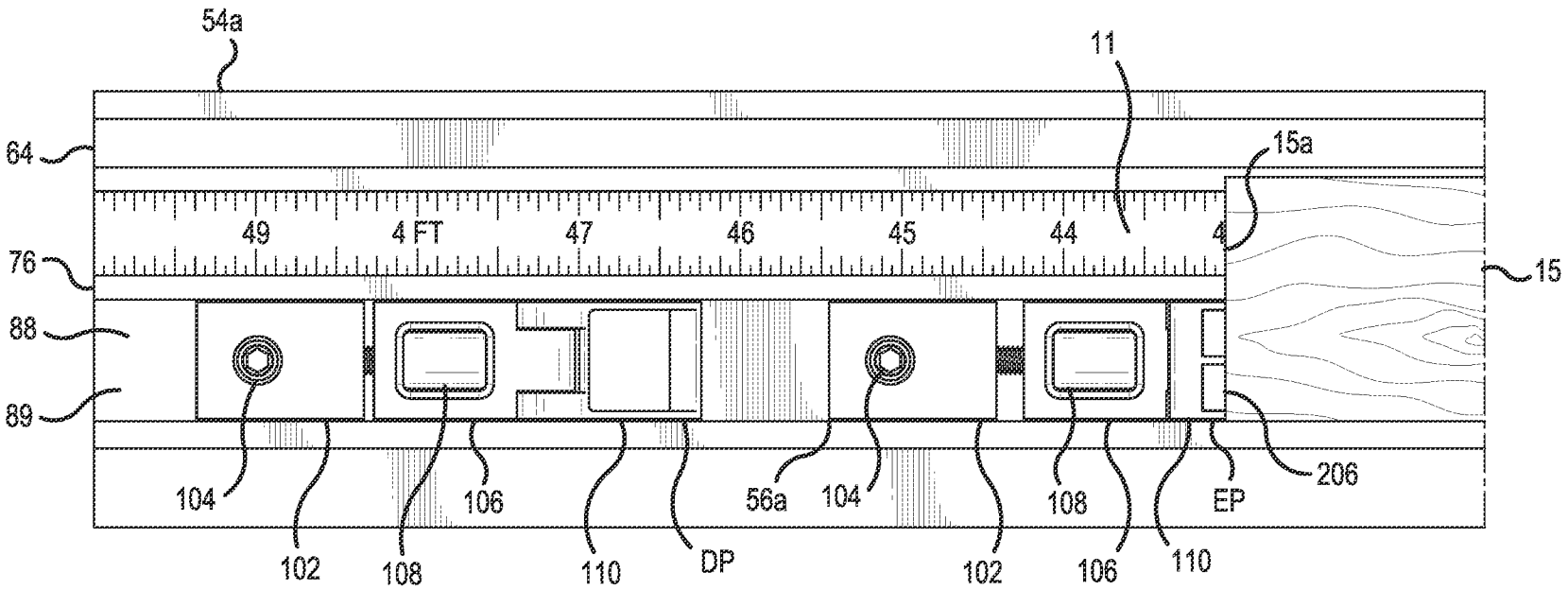
FIG. 15 is a partial operational view showing a workpiece engaging a stop assembly at a distance from the miter saw that is different than the distance shown in FIG. 14.

More particularly, the adjustment wheel 182 may rotate about the thread axis X4 which, in turn, causes the adjustment wheel 182 to engage the second bore section 164*d* of the bore 164 and provide a linear force to move the second portion 106 and the stop portion 110 away from the first portion 102 in the linear direction (e.g., the longitudinal direction) until the stop surface 206 of the stop portion 110 of the first stop assembly 56*a* is precisely aligned with the 42-inch mark of the measurement device 11 (e.g., the stop surface 206 is perpendicular to the front opening 86 of the third track 76 at the 42-inch mark (FIG. 13)), and the stop surface 206 of the stop portion 110 of the second stop assembly 56*b* is precisely aligned with the 47-inch mark of the measurement device 11 (e.g., the stop surface 206 is perpendicular to the front opening 86 of the third track 76 at the 47-inch mark (FIG. 14).

Generally, once the stop surface 206 of the stop portion 110 is at the desired location, the stop surface 206 may releasably engage a workpiece. For example, the workpiece may be a piece of wood having a length greater than a required cut length (e.g., the workpiece may have a length of 60 inches and needs to be crosscut to a length of 47 inches, or a length of 60 inches and needs to be crosscut to a length of 42 inches). As such, a side of the workpiece may releasably engage the first side 68 of the first fence 54*a* and an end of the workpiece may releasably engage the stop surface 206 of the stop portion 110 as more fully described below.

For example, the workpiece may slidably move along the first side 68 of the first fence 54*a* until an end of the workpiece engages the stop surface 206 of the stop portion 110. The end of the workpiece may remain engaged with the stop surface 206 until a crosscut operation is performed on the workpiece, which results in the workpiece having a necessary length.

This process may be repeated to crosscut other workpieces to the same length with accuracy, consistency, and efficiency, or to any other desired length with accuracy, consistency, and efficiency by relocating the stop surface 206 of the stop portion 110 to another desired location.

With primary reference to FIG. 14 and FIG. 15, an implementation showing a first workpiece 13 engaging the stop surface 206 of the stop portion 110 of the second stop assembly 56*b* at a first measured length (i.e., a cut length of the first workpiece 13 relative to the cutting blade 44) and a second workpiece 15 engaging the stop surface 206 of the stop portion 110 of the first stop assembly 56*a* at a second measured length (i.e., a cut length of the second workpiece 15 relative to the cutting blade 44).

With primary reference to FIG. 14, the stop surface 206 of the stop portion 110 of the second stop assembly 56*b* is located at a first desired location (i.e., a cut length of the first workpiece 13 relative to the cutting blade 44). The second stop assembly 56*b* is in the engaged position EP and an end 13*a* of the first workpiece 13 is engaged with the stop surface 206 of the stop portion 110 of the second stop assembly 56*b*. The end 13*a* of the first workpiece 13 may remain engaged with the stop surface 206 of the stop portion 110 until a crosscut operation is performed on the first workpiece 13. The second stop assembly 56*b* may remain in that location in order to cut additional workpieces to that same length. Alternatively, the second stop assembly 56*b* may be moved to another desired location to cut workpieces to a different length.

With primary reference to FIG. 15, the first stop assembly 56*a* is located at a second desired location (i.e., a cut length of the second workpiece 15 relative to the cutting blade 44, which is different than the cut length of the first workpiece 13 shown in FIG. 14). The first stop assembly 56*a* is in the engaged position EP and an end 15*a* of the second workpiece 15 is engaged with the stop surface 206 of the stop portion 110 of the first stop assembly 56*a*. The end 15*a* of the second workpiece 15 may remain engaged with the stop surface 206 of the stop portion 110 until a crosscut operation is performed on the second workpiece 15. The first stop assembly 56*a* may remain in that location in order to cut additional workpieces to that same length. Alternatively, the first stop assembly 56*a* may be moved to another desired location to cut workpieces to a different length.

One of the benefits of using more than one stop assembly includes being able to perform multiple repeatable operations with varying parameters on multiple workpieces (e.g., workpieces need to be crosscut to different lengths with a miter saw). For example, if more than one stop assembly is utilized, a first stop assembly may be positioned at a first desired location (associated with a first workpiece cut length) and a second stop assembly may be positioned at a second desired location (associated with a second workpiece cut length).

When a workpiece needs to be cut to the first workpiece cut length, the first stop assembly may be pivoted to the engaged position, and, if the second stop assembly is at a closer position to the machine tool than the first stop assembly, the second stop assembly may be pivoted to the disengaged position (positioning the entire stop assembly coplanar with, or inwardly of, the imaginary longitudinal vertical plane) to allow the workpiece to pass by the second stop assembly and engage the first stop assembly. Likewise, when a workpiece needs to be cut to the second workpiece cut length, the second stop assembly may be pivoted to the engaged position, and, if the first stop assembly is at a closer position to the machine tool than the second stop assembly, the first stop assembly may be pivoted to the disengaged position (positioning the entire stop assembly coplanar with, or inwardly of, the imaginary longitudinal vertical plane) to allow the workpiece to pass by the first stop assembly and engage the second stop assembly.

It should be noted that structures disclosed as being separately formed can, in other examples, be integrally formed and vice versa. For example, while the pivot shaft 194 has been described as being an element of the stop portion 110 of the first stop assembly 56*a*, it is to be understood that the pivot shaft 194 may be a separate element operably engaged with the second portion 106 and the stop portion 110, or with any suitable element of the first stop assembly 56*a*.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A stop assembly, comprising:

a first portion configured to selectively operably engage inside of a track of a tool, the first portion having:

a first end and a second end spaced longitudinally from one another;

a first side and a second side spaced laterally from one another and defining a first width therebetween; and a first surface and a second surface spaced apart from one another; and a stop portion operably engaged with the first portion and configured to be pivotable between a disengaged position and an engaged position, the stop portion having:

a first end and a second end spaced longitudinally from one another; and a first side and a second side spaced laterally from one another and defining a second width therebetween being substantially equal with the first width; and a nonengaging surface and a stop surface spaced apart from one another;

wherein the stop surface of the stop portion is configured to releasably engage a workpiece; wherein when the stop portion is in the disengaged position, the stop surface faces a first direction relative to the first portion such that the first surface of the first portion is entirely coplanar with first surface of the stop portion in which the first portion and the stop portion lie on a single longitudinal plane; and wherein when the stop portion is in the engaged position, the stop surface faces a second direction relative to the first portion that is different than the first direction; and a fine adjustment assembly operably engaged with the first portion and the stop portion and configured to move the stop portion in a linear direction relative to the first portion, the fine adjustment assembly comprising:

a set screw operably engaged with the first portion and the stop portion;

an expansion bolt operably engaged with the first portion and threadably engaged with the set screw; and an adjustment wheel operably engaged with set screw and completely housed inside of a second portion of the stop assembly that is pivotable engaged with the stop portion.

2. The stop assembly of claim 1, wherein the first direction is perpendicular to the second direction.

3. The stop assembly of claim 1, wherein when the stop portion is in the disengaged position, at least a portion of the stop surface is coplanar with at least a part of the first portion.

4. The stop assembly of claim 1, wherein when the stop portion is in the engaged position, at least a portion of the stop surface is coplanar with at least a part of the first portion.

5. The stop assembly of claim 1, further comprising:

a length of the first portion; and a pivot shaft operably engaged with the first portion and the stop portion; wherein the pivot shaft extends across the length of the first portion.

6. The stop assembly of claim 1, further comprising:

a locking assembly operably engaged with the first portion and adapted to releasably secure the stop assembly to the track of the tool.

7. A stop assembly, comprising:

a first portion configured to selectively operably engage inside of a track of a tool, the first portion having:

a first end and a second end spaced longitudinally from one another;

a first side and a second side spaced laterally from one another and defining a first width therebetween; and a first surface and a second surface spaced apart from one another; and a stop portion operably engaged with the first portion and configured to releasably engage a workpiece, stop portion having:

a first end and a second end spaced longitudinally from one another;

a first side and a second side spaced laterally from one another and defining a second width therebetween being substantially equal with the first width; and a nonengaging surface and a stop surface spaced apart from one another;

wherein the stop portion is pivotable between a disengaged position and an engaged position relative to the first portion; wherein the stop portion moves in a rotational direction toward the first portion when moving from the disengaged position to the engaged position; and wherein when the stop portion is in the disengaged position, the first surface of the first portion is entirely coplanar with the top surface of the stop portion in which the first portion and the stop portion lie on a single longitudinal plane; and a fine adjustment assembly operably engaged with the first portion and the stop portion and configured to move the stop portion in a linear direction relative to the first portion, the fine adjustment assembly comprising:

a set screw operably engaged with the first portion and the stop portion;

an expansion bolt operably engaged with the first portion and threadably engaged with the set screw; and an adjustment wheel operably engaged with set screw and completely housed inside of a second portion of the stop assembly that is pivotable engaged with the stop portion.

8. The stop assembly of claim 7, wherein the stop portion moves in a rotational direction away from the first portion when moving from the engaged position to the disengaged position.

9. The stop assembly of claim 7, further comprising:

a pivot shaft operably engaged with the first portion and the stop portion; wherein the pivot shaft defines a pivot axis; wherein the stop portion pivots about the pivot axis 90 degrees or less between the disengaged position and the engaged position.

10. The stop assembly of claim 7, wherein when the stop portion is in the disengaged position, the stop assembly extends a first longitudinal distance; wherein when the stop portion is in the engaged position, the stop assembly extends a second longitudinal distance; and wherein the first longitudinal distance is greater than the second longitudinal distance.

11. The stop assembly of claim 7, further comprising:

a length of the first portion; and wherein the stop surface of the stop portion configured to releasably engage the workpiece; wherein the stop surface extends a length; and wherein the length of the stop surface is equal to or less than the length of the first portion.

12. The stop assembly of claim 7, further comprising:

a locking assembly operably engaged with the first portion and adapted to releasably secure the stop assembly to the track of the tool.

* * * * *